US006065185A

United States Patent [19]

Breed et al.

[11] Patent Number: 6,065,185

[45] Date of Patent: May 23, 2000

[54] VEHICLE INFINITE DOOR CHECK

[75] Inventors: David S. Breed, Boonton Township, Morris County; William Thomas Sanders, Rockaway Township, Morris County, both of N.J.

[73] Assignee: Automotive Technologies International Inc., Denville, N.J.

[21] Appl. No.: 09/040,206

[22] Filed: Mar. 17, 1998

[51] Int. Cl.[7] ..... E05F 5/00; E05C 17/04

[52] U.S. Cl. ..... 16/86 C; 16/82; 16/337; 292/275

[58] Field of Search ..... 16/82, 86 C, 337; 292/275

[56] References Cited

U.S. PATENT DOCUMENTS

| | | | |
|---|---|---|---|
| 406,840 | 7/1889 | Jones | 292/275 |
| 2,232,986 | 2/1941 | Westrope | 16/86 C |
| 2,268,976 | 1/1942 | Westrope | 292/275 |
| 2,268,977 | 1/1942 | Westrope | 292/275 |
| 2,882,548 | 4/1959 | Roethel | 16/86 |
| 2,992,451 | 7/1961 | Schonitzer et al. | 16/141 |
| 3,345,680 | 10/1967 | Slattery | 16/140 |
| 3,461,481 | 8/1969 | Bachmann | 16/140 |
| 3,584,333 | 6/1971 | Hakala | 16/14 |
| 3,643,289 | 2/1972 | Lohr | 16/142 |
| 3,965,531 | 6/1976 | Fox et al. | 16/140 |
| 3,969,789 | 7/1976 | Wize | 16/145 |
| 4,069,547 | 1/1978 | Guionie et al. | 16/85 |
| 4,332,056 | 6/1982 | Griffin et al. | 16/341 |
| 4,532,675 | 8/1985 | Salazar | 16/335 |
| 4,628,568 | 12/1986 | Lee et al. | 16/337 |
| 4,720,895 | 1/1988 | Peebles | 16/264 |
| 5,018,243 | 5/1991 | Anspaugh et al. | 16/335 |
| 5,074,010 | 12/1991 | Gignac et al. | 16/334 |
| 5,173,991 | 12/1992 | Carswell | 16/86 A |
| 5,346,272 | 9/1994 | Priest et al. | 296/146.11 |
| 5,452,501 | 9/1995 | Kramer et al. | 29/11 |
| 5,474,344 | 12/1995 | Lee | 292/262 |
| 5,482,144 | 1/1996 | Vranish | 188/6 |

FOREIGN PATENT DOCUMENTS

| | | | |
|---|---|---|---|
| 614441 | 2/1961 | Canada | 292/275 |
| 4207706 | 9/1993 | Germany | 16/221 |
| 833844 | 5/1960 | United Kingdom | 16/82 |

OTHER PUBLICATIONS

"Sprag Design Adds New Dimension", D.J. Bak, Design News, Mar. 3, 1997, p. 130.

*Primary Examiner*—Chuck Y. Mah
*Assistant Examiner*—Donald M. Gurley
*Attorney, Agent, or Firm*—Brian Roffe

[57] ABSTRACT

An infinite door check mechanism for enabling a door to be moved from a closed position in a door frame to any one of a plurality of different open positions including a clevis adapted to be mounted to the frame, an elongate strip member mounted to the clevis and directed outward from the frame, a door check housing adapted to be mounted on the door, the strip member extending at least partially through the housing, and a support member arranged in the housing. A movable locking member is arranged in the housing such that the strip member is interposed between the locking member and the support member. A biasing member such as a spring is positioned in the housing for selectively pressing the locking member against the strip member to force the strip member against the support member and thereby retain the strip member in a fixed position and releasing pressure of the locking member against the strip member and thereby enable movement of the strip member. Structure is also provided to exert a drag force onto the strip member to enable the locking member to rotate without slipping.

37 Claims, 23 Drawing Sheets

VEHICLE INFINITE DOOR CHECK

CROSS-REFERENCE TO RELATED APPLICATION

This application claims priority under 35 U.S.C. §119(e) of U.S. provisional patent application Ser. No. 60/040,977 filed Mar. 17, 1997.

BACKGROUND OF THE INVENTION

1. Field of the Invention

The present invention relates to holding devices for doors and more particularly to holding devices for the doors of vehicles and most particularly for automobile and truck doors and the like. Door holding devices of the kind provided by this invention are often referred to as infinite-position holding devices or infinite position door checks because they act to hold the door in any open position to which it is moved and left standing, but still permit the door to be readily moved to any other desired position.

2. Description of the Prior Art

A door check mechanism is usually present on each vehicle door on all automobiles, recreational vehicles, vans, trucks, and virtually all other vehicles. In many designs, the door check mechanism provides two open detented positions, one at which the door is partially open and the other at which the door is fully open. In some cases, the door check mechanism for a vehicle door provides only one open retention position.

Door check mechanisms of the fixed detent type are quite common and have been used for many years. However, they are far from uniform in construction or in application. In many vehicles, the manufacturer provides a check mechanism that is separate from the door hinges and it is typically mounted at a location midway between the two hinges. In other instances, one of the hinges incorporates a check mechanism in the hinge structure itself.

Attempts have been made to incorporate an infinite door check mechanism into a vehicle and a number of patents have been issued covering such devices (discussed below). None has yet achieved commercial success due to the cost and complexity and well as the short service lives of these prior art mechanisms.

Door check mechanisms have in general exhibited some substantial difficulties over the years including: (i) the need in some designs for frequent lubrication without which they tend to make undesirable noises; (ii) inadequate operating life; (iii) corrosion; (iv) the inability to endure vehicle body processing temperatures associated with the curing of external finishes (400° F.); (v) the inability to be easily separated from the vehicle after painting to permit the door to be separately trimmed and then reassembled to the body; (vi) the occurrence of unacceptable stress and wear on the door hinges caused by loading from the door check; and (vii) the requirement for frequent post installation adjustment during the vehicle life. Each of these problems has been addressed in one or more of the prior art fixed detent door checks but there is no infinite door check that has solved all of these problems.

The tendency for an automobile door to swing open or closed when not desired is frequently caused by factors such as the transverse curvature or crown of a pavement or road, by the slope of a hill, or by a gust of wind. Such a tendency, when in the closing direction, causes the door to strike the legs or other parts of a person entering or leaving the automobile. When in the opening direction, it can cause the door to impact into other people or objects inflicting harm or damage thereto. A particularly costly problem, as reported by automobile insurance companies, happens in parking lots where the opening door of one vehicle bangs into an adjacent vehicle causing damage to the finish that can lead to an insurance claim. This increases the cost of insurance to all automobile owners.

To partially solve this problem, vehicle doors are frequently provided with an inclined hinge axis incident to body design that biases the door to close. This is a desirable feature since it aids in the closing of the door especially by older or physically impaired people and should not be defeated as is done by some infinite position door checks which maintain a friction drag on the vehicle door at all times.

As discussed below, this tendency of a vehicle door to swing in an unwanted manner is prevented or minimized by the infinite door check means of the present invention which is effective to hold the door in any open position in which it is left standing, while permitting a relatively free manual movement of the door to any other desired position and a free self closing action when that is desired. This invention also provides an infinite position door checking mechanism that solves all of the problems of prior art infinite position door checks listed above in a simple and cost effective design. In the context of automobile manufacturing, for example, most of the design implementations of this invention permit the door to be easily removed from the vehicle for trimming and then reassembled entailing only the removal and replacement of a single pin.

The infinite position door check mechanism for regulating pivotal movement of a vehicle door between a closed position and any open position, which mechanism is sometimes incorporated in a hinge, includes an elongated strip member having a flat or curved surface; a cam, or other locking member, which engages one of the strip surfaces with varying amounts of pressure contact depending on whether the door is in the freely opening or closing mode, checked against movement in one direction or checked against movement in both directions. Either the cam or the strip member typically has a resilient plastic, brake material or other non-metallic surface, the other surface generally being metal. The engaging portions of the cam and strip member surfaces are thus preferably dissimilar materials, usually a metal and a non-metal.

Pertinent prior art includes the following:

U.S. Pat. No. 2,882,548 to Roethel is one of the early patents on door checks. The checking is done by friction drag that is increased at two checking positions. The effectiveness of this system is degraded when the coefficient of friction changes, and the system has a limited life.

U.S. Pat. No. 2,992,451 to Schonitzer et. al. describes a design that uses continuous sliding friction of a nylon plunger spring loaded against a ramp member. Some viscoelastic effect, or static/dynamic friction, takes place when the door is held in a particular position slightly increasing the resistance to further motion. Problems arise with regard to dirt, moisture, temperature, wearing etc. This may be the first infinite door check patent. The holding power is stronger when the door is in the open position. The continuous friction defeats the automatic door closing system. The holding force is designed to exactly counter-balance the tendency of the door to close by itself. The system is also dependent on sliding friction and therefore strongly affected by the surface condition that may have a coating of oil, grease, moisture etc. or be dry.

U.S. Pat. No. 3,345,680 to Slattery describes a friction type door checking device that is designed to hold the door in discrete positions. It has the same problems as Schonitzer et al.

U.S. Pat. No. 3,461,481 to Bachmann describes an infinite position door checking device based on a frictional locking mechanism. The frictional locking mechanism is held in contact with the friction surfaces by means of a biasing spring that exerts its maximum torque and thus creates the maximum wear when the mechanism is in the unlocked position.

U.S. Pat. No. 3,584,333 to Hakala describes an infinite position door check system in which a contact edge of the detent member digs into the friction member to provide a wedging restraint to hold the door. It is thus a friction-based system. The torque spring has its maximum force in the non-detented positions, thus, maximum drag. The system requires careful alignment and is subject to wear. Thus the characteristics will change over time. It does not have an intermediate detenting position. The normal tendency of the door to close under gravity causes the detenting action. The frictional drag works to prevent the door from closing under its own weight thus defeating that desirable function.

U.S. Pat. No. 3,643,289 to Lohr describes a device including an infinite position hold open hinge. This device is a totally sliding friction dominated system using a plastic brake. A greater force is required to close the door than is required to open the door. There is drag on the door in both directions and higher drag in the closing direction. The brake is made of a material such as nylon or polyurethane that the inventor claims has both a high static coefficient of friction and low sliding coefficient of friction. Although this is the goal, this cannot be achieved due to surface contamination.

U.S. Pat. No. 3,969,789 to Wize describes a system with four detents thus providing multiple locations for the door. The detenting mechanism slides smoothly over the detents as long as torque is applied to the door. When motion is stopped, the detent falls into the closest spot. This may cause significant motion of the door to get to the nearest door detent. There also is an alignment problem with this device. The detenting is done with rollers, however, so there is no sliding friction except for the friction spring associated with the mechanism that carries the detents over the detenting holes or slots.

U.S. Pat. No. 3,965,531 to Fox et al. describes an infinite position door hold open using continuous sliding friction to wedge a brake to create a much larger friction. The device is complicated, requires adjustment, is sensitive to dirt, and has no positive intermediate position. Thus, as with all other infinite door checks discussed thus far, the door is either in a position where it will move relatively easily toward a more open position but is checked against closing or else it is in a position where it will move freely toward the closed position but is checked against opening. The friction surfaces are knurled and adjustment is required during the life of the vehicle due to wear of brake surfaces.

U.S. Pat. No. 4,069,547 to Guionie et. al. describes a device using a four-bar linkage structure that has the advantage of keeping the detenting system aligned. Otherwise, it is a single position door checking mechanism. The checking motion is rather small, probably resulting in significant variation in the checked position from vehicle to vehicle.

U.S. Pat. No. 4,332,056 to Griffin et. al. describes an infinite position door check that does not have an intermediate position. It uses a roller that rubs continuously on the friction surface resulting in a wear problem. It can also defeated by moisture, oil, or other contaminant etc. on the rubbing surfaces. For this reason, the hard rubber chosen as the friction surface is a poor choice since the friction coefficient is strongly influenced by surface films. The roller moves from one position to another based on differences in the friction coefficients between the biasing plunger and the hard rubber coated arcuate friction surface. This system requires adjustment when installing on vehicle.

U.S. Pat. No. 4,532,675 to Salazar describes a door hold open door check which is only engaged when the door is in the fully open position. Therefore, the parts are not under continual cyclical stress as which reduces the wear problem.

U.S. Pat. No. 4,628,568 to Lee et. al. describes an infinite position door check system based on a difference between a high static coefficient of friction and low sliding coefficient of friction such as nylon or polyurethane. This is unsustainable as surface films will radically change the friction coefficients. Since significant friction is always present, there is a wear problem resulting in a device with a short life without adjustment.

U.S. Pat. No. 4,720,895 to Peebles describes a quick disconnect door hinge with an integral discrete position door check. It solves the problem of being able to paint the door on the body and then disassembling it for trimming and later reassembling it to the vehicle in an easy manner.

U.S. Pat. No. 5,018,243 to Anstaugh et al. describes the use of a polyester urethane material for coating the roller. This material is good from −40° to 400° F. and lasts substantially longer than nylon if it is backed up by metal. Additionally, it is substantially quieter than the nylon on metal system used in the prior art.

U.S. Pat. No. 5,074,010 to Gignac et al. describes a detent system and shows the many different geometries that have been adopted by various vehicle manufacturers. It claims advantages in either the roller or the track having a resilient elastomer core, preferably an elastomer material (e.g., a silicone polymer) that retains its elastic properties over a wide temperature range.

U.S. Pat. No. 5,173,991 to Carswell addresses some of the force components that can cause noise and premature failure of door check mechanisms. The design described in this patent is a discrete door check that is claimed to be quite and have a long life. Once again, the contacting materials are discussed and this patent recommends coating the link arm with Milon by DuPont that is moldable material. The bearing ball purportedly provides three degrees of freedom where as the prior art devices with rollers allow for only two degrees of freedom with the result of a fair amount of grinding of the housing adjacent the edges or shoulders of the link member. The ball system gives point contact, therefore higher forces and therefore greater wear. It has not been rear that this problem can and has been solved in prior art devices by placing the rollers with their axes in a vertical direction. Although the ball rolls in the groove, on which the patent makes a great issue, it is sliding on the elastomeric spring that pushes it down. This sliding friction will cause wear and shorten the life of the door check.

U.S. Pat. No. 5,346,272 to Priest et al. describes a door hinge with infinitely adjustable detent or door check. It is significant since it is the first attempt to apply electronics to this problem. There is no obvious advantage to this overly complicated system since to deactivate the door holding system, the door must be moved which requires a force. The same force can be used to remove the detent in a pure mechanical system.

U.S. Pat. No. 5,452,501 to Kramer et al. describes a device in which the detent force acts vertically so as to not load the pivot pin. However, in this case, the hinge pin is still loaded when the door is moved into and out of the detented positions and thus the problem is only partially solved. Any detenting system will put a couple onto the hinge pin.

U.S. Pat. No. 5,474,344 to Lee describes a device which is almost a duplicate of the Carswell patent (U.S. Pat. No. 5,173,991) except rollers are used instead of balls. In this patent, the body as well as the cover are all made from plastic. Significantly, there is a pad disclosed for the prevention of the introduction of foreign substances into the locking unit.

Although each of the above references attempts to solve one or more of the problems listed above, in contrast to the infinite position door check described herein, in no case is there provided an infinite door check mechanism which solves substantially all of these problems. As a result, there is no successful infinite door check in high volume commercial use at this time although the desire for such a device is well known in the industry.

OBJECTS AND SUMMARY OF THE INVENTION

Accordingly, it is an object of the invention to provide new and improved door check mechanisms for regulating movements of a vehicle door.

It is another object of the present invention to provide new and improved door check mechanisms which provide positive retention of the vehicle door in an infinite number of open positions without interfering with the normal opening and closing movements of the doors, yet exhibit long life and are essentially unaffected by high or low temperatures.

Further objects and advantages on this invention include, to provide an infinite position door check mechanism which does not require lubrication; has an operating life equivalent to that of the vehicle; does not corrode; is able to endure vehicle body processing temperatures associated with the curing of external finishes (400° F.); is able to be easily separated from the vehicle after painting to permit the door to be separately trimmed and then reassembled to the body; is simple and inexpensive to manufacture and install; does not result in unacceptable stress and wear on the door hinges caused by loading from the door check; does not require post installation adjustment during the vehicle life; and has the capability to be released electrically permitting the vehicle door to close under its own weight.

Accordingly, in one preferred embodiment, the invention relates to an infinite position door check mechanism for regulating movement of a vehicle door, pivotally mounted on a first support element comprising part of a vehicle frame, between a closed position and an open position that is displaced from the closed position by an angle, the vehicle door including a second support element. The door check mechanism comprises a strip member, including an elongated substantially flat smooth surface, a detent cam or other locking member, and mounting means for mounting the strip member on one of the support elements and for mounting the detent cam member on the other of the support elements with the detent cam member aligned with the strip surface. The detent cam member has a rigid surface with a varying radius about its rotation axis that engages the strip member. The strip member has a coating of a polymeric or other non-metallic material on those surfaces that engage the cam. Either a second detent cam member or a support member is provided on the opposite side of the strip from the first cam member. The strip surface and the external surface of the detent cam are thus formed of dissimilar materials. The detent cam is mounted so that when engaged in a detenting relationship with the strip, it is resiliently pressed against the strip. The resilient cam mounting means and the support means conjointly maintain the detent cam member in pressure rolling engagement with the strip surface during the detenting operation. During other motions of the door, the detenting cam slides on the strip with very little force. The alignment of the cam member and the strip surface cause the detent cam member to detentingly engage with the strip when the door is pivoted to any partially open position and a force is exerted in the opposite direction so that the detent cam member and the strip member releasably maintain the door in any desired open position.

In a basic embodiment of the infinite door check mechanism for enabling a door to be moved from a closed position in a door frame to any one of a plurality of different open positions, the mechanism comprises an elongate strip member mounted to the frame and directed outward from the frame, a door check housing adapted to be mounted on the door, the strip member extending at least partially through the housing, a support member arranged in the housing, a movable locking member arranged in the housing such that the strip member is interposed between the locking member and the support member, and biasing means for selectively pressing the locking member against the strip member to force the strip member against the support member and thereby retain the strip member in a fixed position and releasing pressure of the locking member against the strip member and thereby enable movement of the strip member. The strip member may be arcuate and fixedly or movably mounted to the frame, e.g., pivotally mounted by means of a clevis attached to the frame. The strip member has opposed longitudinally extending surfaces, one of which engages the locking member and another of which engages the support member. The door check mechanism may be mounted either horizontally or vertically in the door.

In certain embodiments, the locking member is a cam including an integral cam shaft defining a rotational axis for the cam or the cam shaft may be fixed in the housing or cam holder and pass through a slot in the cam. The cam has an irregular shape and is arranged to press the strip member against the support member with a variable force depending on the position of the cam. The main door check force is thus the frictional sliding resistance between the strip and the cam or locking member. With respect to the irregular shape of the cam, it may include a first flat surface having edges and second and third arcuate surfaces alongside a respective edge of the first flat surface such that the radial distance at the edges is greater than the radial distance of the first flat surface. If a cam holder is fixedly connected to the cam, the cam holder has an edge adapted to contact the support member once the second or third arcuate surface contacts the strip member such that the biasing means presses the cam holder against the support member thereby releasing pressure applied by the biasing means to force the strip against the support member and enabling the strip member to move, i.e., to any number of different positions relative to the door check housing and thus enable the door to be opened to any desired degree. The cam also includes fourth and fifth recessed arcuate surfaces on an opposite side of the cam from the first flat surface, and rotation limiting means arranged in the housing for limiting rotational movement of the cam, e.g., a tab at least partially extending into one of the fourth and fifth recessed surfaces.

If the locking member is fixed to a locking member holder, an edge of the locking member is adapted to contact the support member upon rotation of the locking member such that the biasing means press the locking member holder against the support member thereby releasing pressure applied by the biasing means to force the locking member against the support member with the strip member interposed between the locking member and the support member and enabling the strip member to move, i.e., to any number of different positions relative to the door check housing and thus enable the door to be opened to any desired degree. Rotation limiting means may be arranged in the housing for limiting rotational movement of the locking member, e.g., a tab at least partially extending into a recessed surface of the locking member. The biasing means may comprise an elastic spring operative at one end against the housing and operative at an opposite end against the locking member holder.

It is an important feature of the invention that drag exerting means are present for exerting a drag force onto the strip member to enable the locking member to rotate without slipping. This may comprise one or more elastica springs, each mounted at one end to the locking member holder and bearing against the locking member at an opposite end. If the locking member is a cam, the elastic springs bear against the fourth and fifth recessed arcuate surfaces, thereby exerting a torque on the cam urging it back to the checked position. In the alternative, the drag exerting means comprise a cantilevered spring mounted at one end to the locking member holder and having its opposite end movable between two projections arranged on the locking member.

In some embodiments, the support member comprises an additional movable locking member arranged such that the strip member is interposed between the two locking members. In this case, the drag exerting means may comprise elastica springs, each pivotally mounted at one end to the locking member holder and bearing against the locking member at an opposite end, e.g., against a respective recessed arcuate surface thereof.

In other embodiments, the strip member is serrated on a surface engaging the locking member to thereby form alternating teeth and grooves and the locking member has a tip positionable within one of the grooves. Thus, the locking member may include a pair of arcuate surfaces adapted to be pressed against the strip member and a pointed tip defined between the arcuate surfaces. In any of the embodiments disclosed herein, the locking member may have a beveled edge and the strip member has a groove for at least partially receiving the beveled edge of the locking member. This creates a sprag effect and increases the frictional force of the locking member against the strip and results in some additional ware.

The door check mechanism in accordance with any of the embodiments of the invention disclosed herein may be incorporated together with an automatic door closing apparatus for enabling the door to close automatically under its own weight or by electric motor. Such an apparatus may comprise a motor coupled to the housing, and a rod extending into engagement with a support bracket associated with the locking member and actuatable by the motor to pull the locking member away from the strip member.

In another embodiment, the infinite door check mechanism in accordance with the invention comprises a door check housing adapted to be mounted on the door, a support member adapted to be mounted to the frame, the support member including a hinge pin defining a rotational axis about which the support member is rotatable, a hinge member arranged around the hinge pin, a movable locking member arranged in the housing to engage the hinge member, and biasing means arranged in the housing for selectively pressing the locking member against the hinge member to force the locking member against the hinge member and thereby retain the hinge member and thus the door in a fixed position and releasing pressure of the locking member against the hinge member and thereby enable rotation of hinge member and thus the door. The mechanism may include a locking member holder fixedly connected to the locking member whereby the biasing means comprise a strip of bent spring material arranged in the housing to exert pressure against the locking member holder and thus the locking member. As noted above, drag exerting means are provided for exerting a drag force onto the hinge member to enable the locking member to rotate without slipping, e.g., at least one elastica spring structured and arranged to apply a torque to the locking member, each mounted at one end to a locking member holder and bearing against the locking member at an opposite end.

The infinite door check mechanism may be arranged opposite to that described immediately above in that the door check housing is mounted on the frame of the vehicle and the support member is mounted to the door, the support member including a hinge pin or member defining a rotational axis about which the support member is rotatable. In this case, the hinge member is arranged around the hinge pin and connected to the door to enable the door to rotate about the axis.

BRIEF DESCRIPTION OF THE DRAWINGS

The invention will be described with reference to the following non-limiting drawings.

DESCRIPTION OF THE PREFERRED EMBODIMENTS

Figure 1:
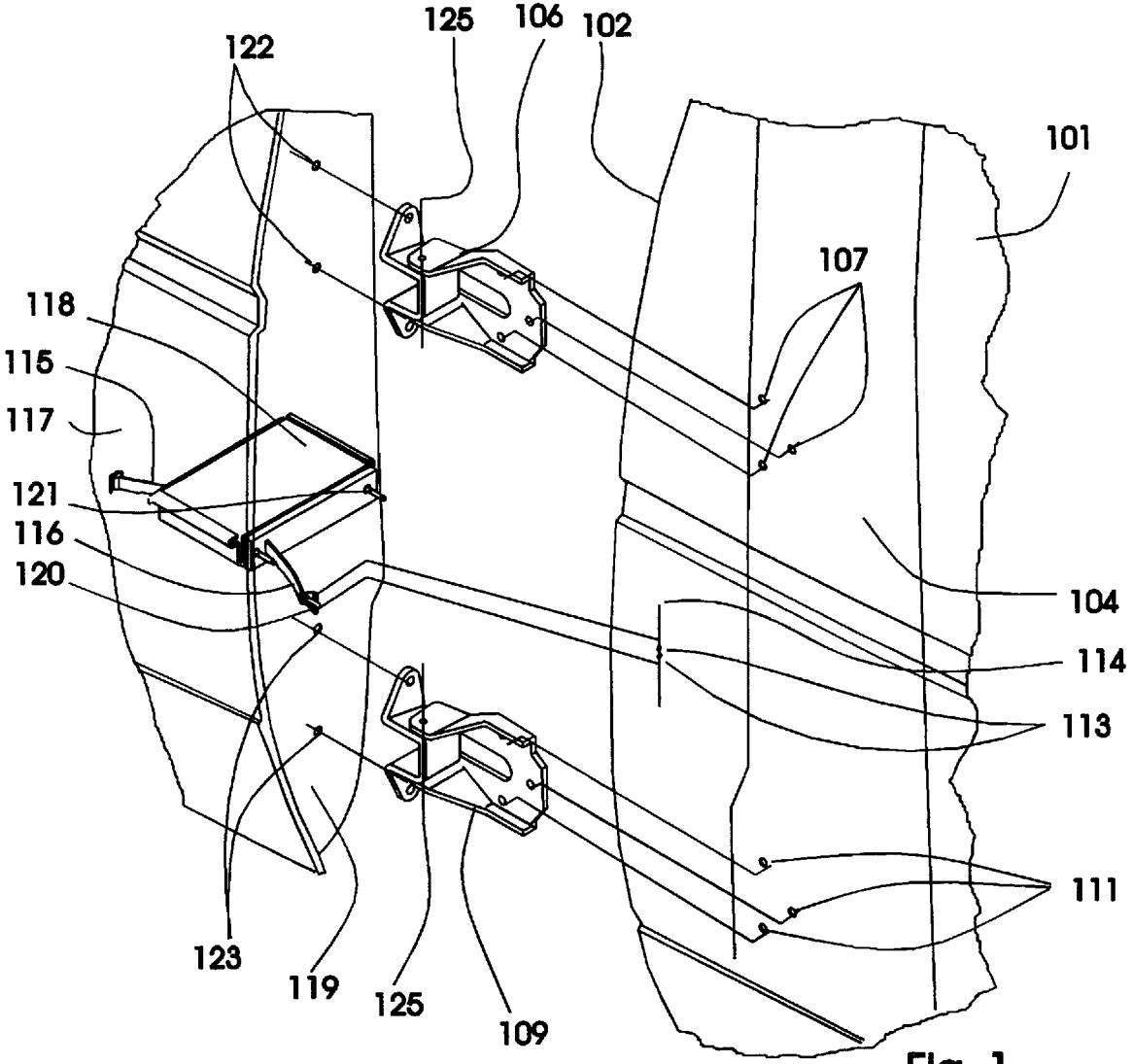
FIG. 1 is a partially exploded perspective view of a vehicle door mounting, employed to describe and illustrate use of a door check mechanism in accordance with the invention.
Figure 2:
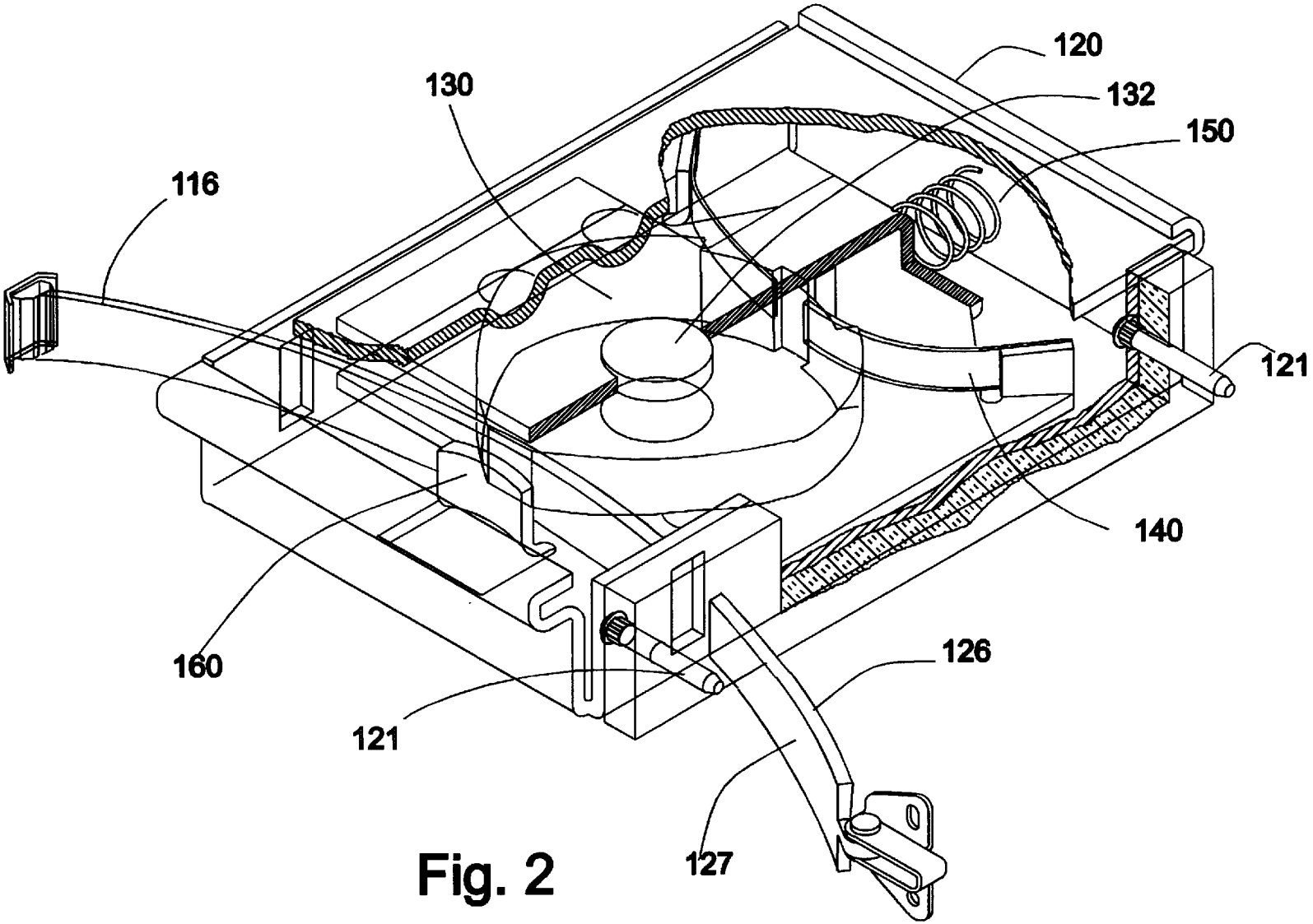
FIG. 2 is a perspective view of a vehicle door check mechanism constructed in accordance with one embodiment of the invention where the door check is separate from the door hinge.

Referring to the accompanying drawings wherein like reference numerals refer to the same or corresponding parts throughout the several views; FIG. 1 is a partially exploded perspective view of a portion of the side of a vehicle, which could be an automobile or virtually any other kind of vehicle, including a part of a door opening. A portion of the right front side body of the vehicle is shown at the right-hand side and a portion of the door is shown on the left-hand side of FIG. 1 respectively. The edge of the door opening, along the left-hand vertical side of body member 101, is identified by reference numeral 102. Closely adjacent to the edge of the door opening 102, there is a vertical frame member 104, a part of the vehicle frame that may be the A-pillar. The terms vertical frame member and A-pillar are used interchangeably herein although the vertical frame pillar may be other than the A-pillar such as the B-pillar if the door is a rear door of a four door vehicle.

The door portion shown in FIG. 1 includes an upper hinge 106 that includes appropriate mounting means for mounting it on the vertical frame member or A-pillar 104 at a plurality of mounting locations 107, e.g., three mounting locations at which screws or welds are provided. Similarly, there is a second, lower hinge 109 that is fastened to the A-pillar 104 at a plurality of mounting locations such as the mounting locations 111, again by appropriate mounting means such as screws or welds. Additionally, a clevis 120, having a vertical axis 114, is shown mounted on the A-pillar 104 at a plurality of mounting locations 113. The clevis 120 is a part of a door check mechanism 118 comprising one embodiment of the present invention and is described more fully below. The clevis 120 affords a pivotal connection for an elongated strip member 116 that projects outwardly from A-pillar 104 and the clevis 120 toward a door 117. Strip member 116 extends through a housing of the door check mechanism 118 that is mounted on door 117. The clevis 120 may be omitted in its entirety and the strip member 116 either rigidly mounted to the A-pillar 104 in some cases, pivotally mounted directly to the A-pillar 104 or flexibly mounted to the A-pillar 104.

Door 117 includes a vertical support member 119 that is an integral part of the door. Door check mechanism 118 is mounted on the support member 119 by fastening means indicated generally as 121. Upper hinge 106 is mounted on door 117, preferably as indicated at mounting locations 122, and more particularly on support member 119. Similarly, the lower hinge 109 is mounted on the support member 119 at mounting locations 123. The hinges 106,109 have a common pivotal axis 125 for enabling pivotal movement of the door.

Figure 3:
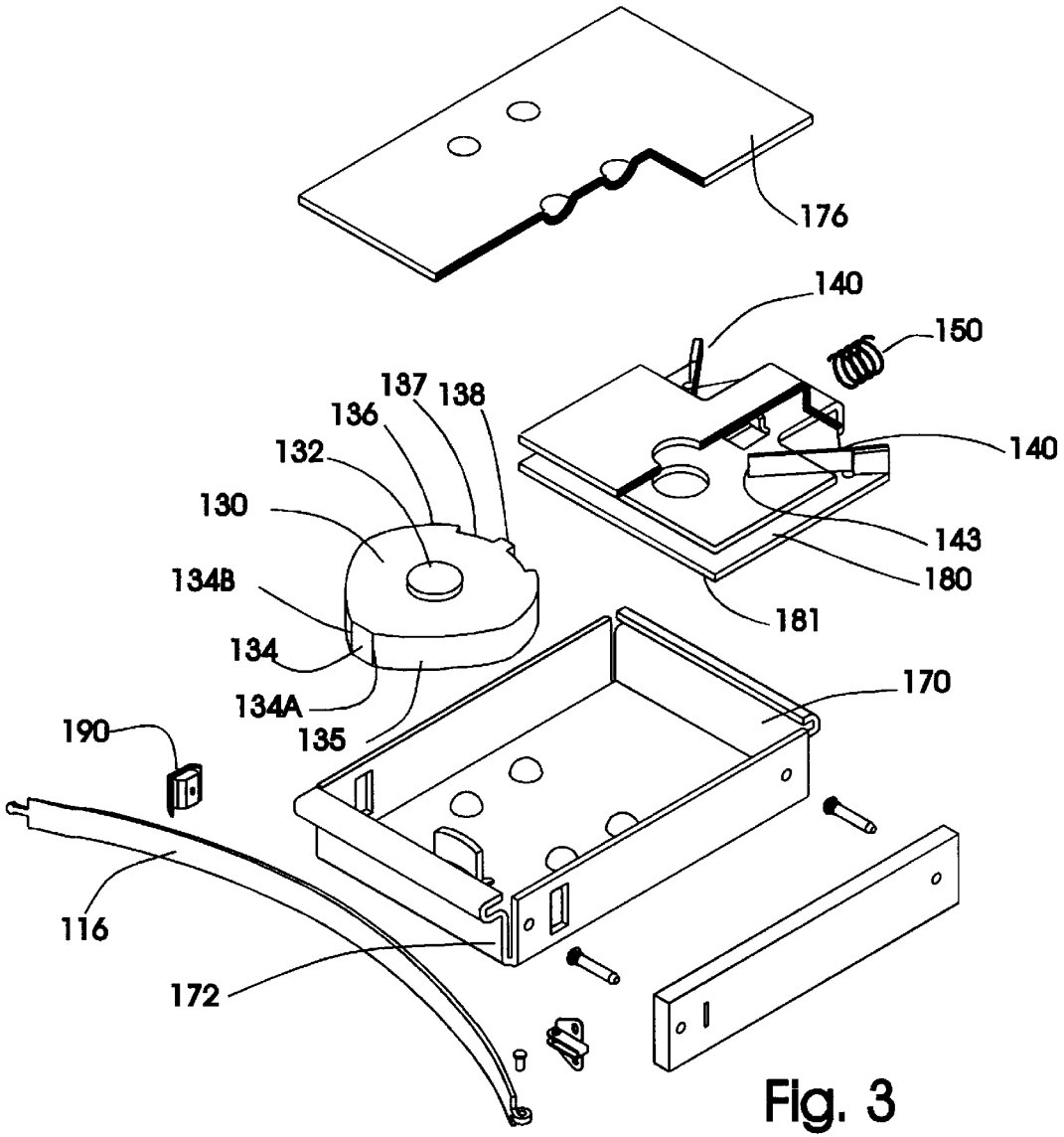
FIG. 3 is an exploded perspective view of the door check mechanism of FIG. 2.

In one preferred form of the door check mechanism 118 that is shown in FIGS. 2–5, strip member 116 is arcuate and has two opposed, longitudinally extending flat surfaces 126 and 127. A locking member such as a locking cam 130 is arranged in a housing 170 of door check mechanism 118 and has an integral cam shaft 132 and a profile around its circumference composed of sections 134, 135, 136, 137 and 138, each of which will now be described (FIG. 3). The cam 130 interacts with the strip member 116 pressing it against a support member 160 with varying amounts of force depending on the rotational position of the cam 130. In the views illustrated in FIGS. 2, 4A and 5, the cam 130 is in the totally checked position which requires a force to either further open or close the door, that is to move the strip to the right or the left in FIG. 4A. In this position, cam profile portion 134 at the maximum radial distance from the cam shaft 132, is in contact with the strip member 116 and thus has compressed a biasing spring 150. Biasing spring 150 thus causes cam 130 to exert a force against the strip member 116 that is supported by support member 160. For the strip member 116 to move from this position, sufficient force must be applied to the strip member 116 to cause the cam 130 to rotate further compressing spring 150, since edges 134A and 134B of cam profile portion 134 are at a larger radial distance from the cam shaft 132. The applied force to the strip member 116 additionally must be sufficient to overcome the frictional force exerted by support member 160 against strip member 116. The combination of these forces effectively maintains the strip member 116 in the detented position shown in FIG. 4A against forces caused by most wind gusts and from gravity caused by the vehicle being parked on a hill, for example.

At this juncture, it should be appreciated that the locking member may be other than the irregularly shaped cam shown in FIGS. 2–5 and indeed, other locking members are within the scope and spirit of the invention.

Figure 4A:
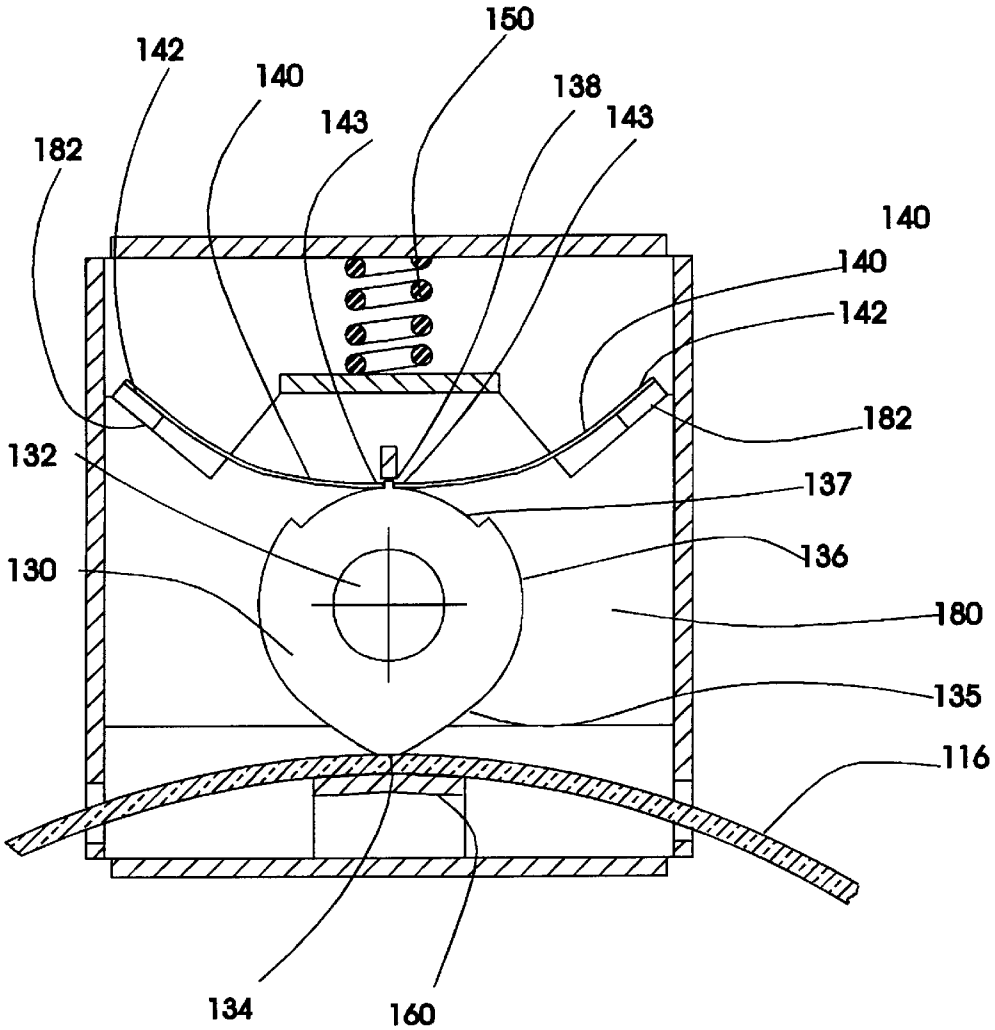
FIG. 4A is a view of the cam and strip member illustrating the mechanism in the detenting position where the cam opposes motion of the strip member in either the door opening or door closing directions.
Figure 4B:
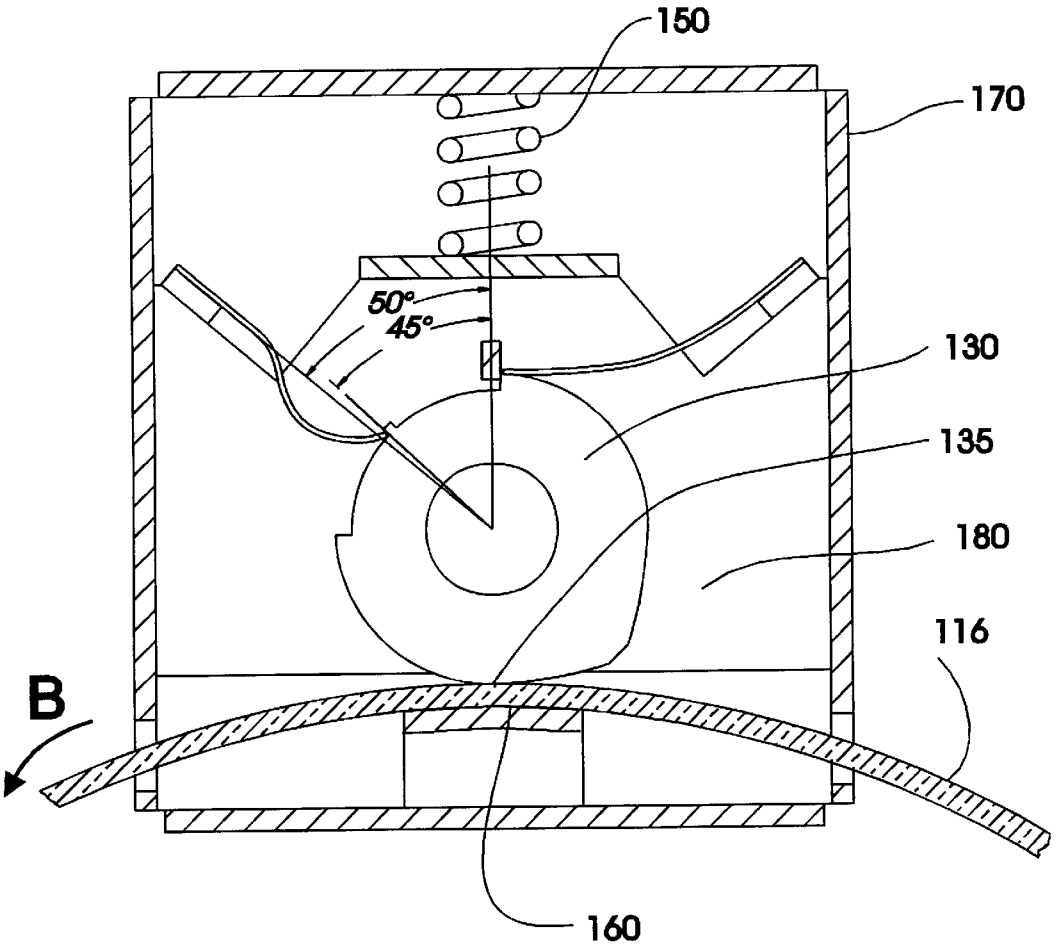
FIG. 4B is a view of the cam and strip member illustrating the mechanism in the non-detenting position where the cam permits free motion of the door in the door opening direction but opposes motion in the door closing direction.

If sufficient force is applied to overcome the forces described above in, for example, the direction to open the door 117, then the cam 130 will rotate to the position as shown in FIG. 4B at which point the cam profile portion 135 is now in contact with the strip member 116. In this position, the cam 130 has moved with cam holder 180, which is fixedly connected to the cam shaft 132, as far as it can go with a front edge 181 in contact with support 160 of housing 170. The entire force exerted by spring 150 is now countered by a force from support 160 onto cam holder 180 and thus the cam 130 no longer exerts a significant force on the strip 116 and the strip 116 moves freely to the right as shown in FIG. 4B. Similarly, sufficient force applied on the strip member 116 to the left in FIG. 4A, toward closing the door, places the cam 130 in the position as shown in FIG. 4C permitting the door to be closed with little additional effort or under its own weight as described in more detail below.

Figure 4C:
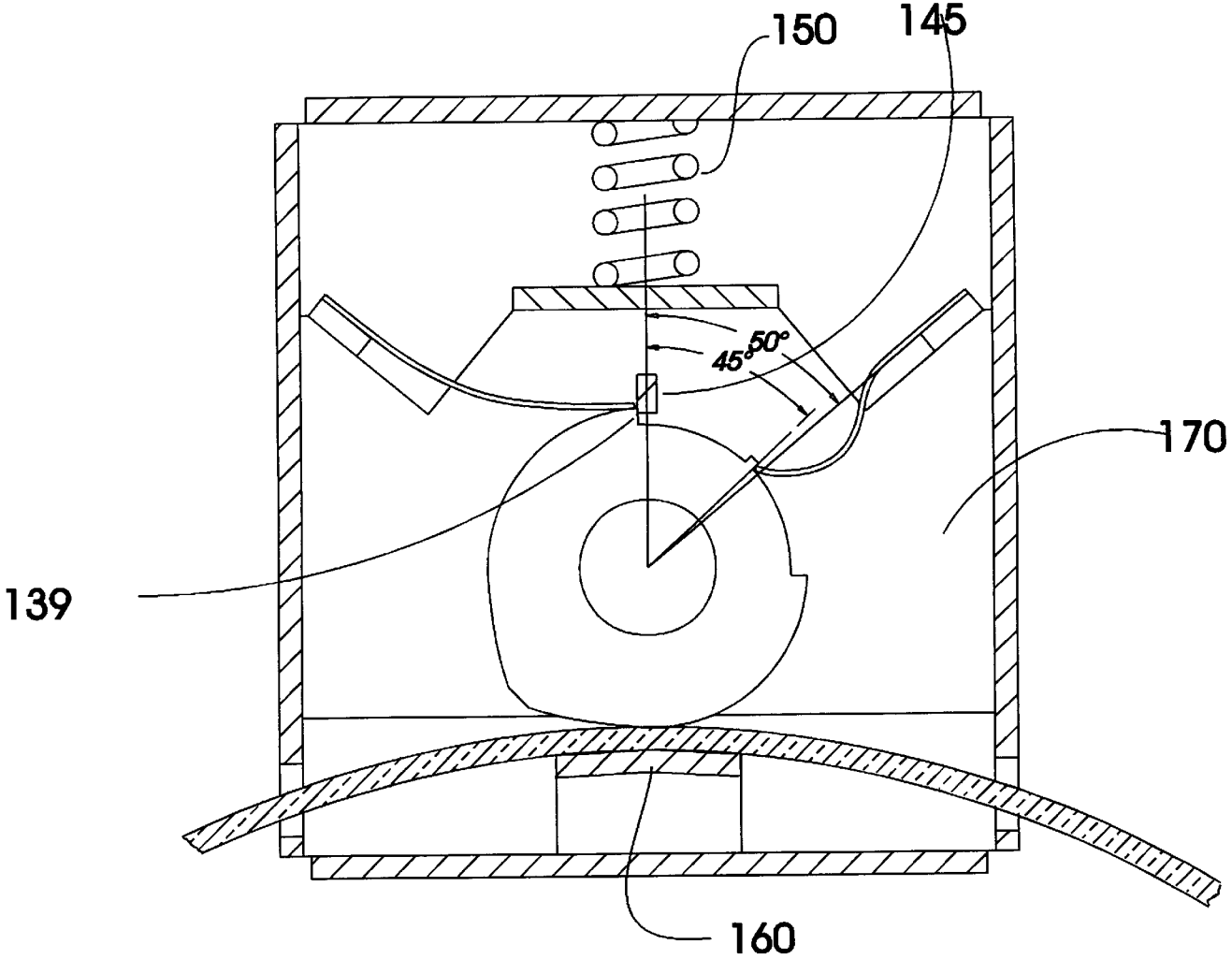
FIG. 4C is a view of the cam and strip member illustrating the mechanism in the non-detenting position where the cam permits free motion of the door in the door closing direction but opposes motion in the door opening direction.

FIG. 4C also illustrates the interaction of tab 145 attached to cam support 170 with edge 139 of cam 130 which limits the rotation of cam 130 and prevents the snap through of the elastica springs 140. Tab 145 is at least partially received within the recessed arcuate surfaces 137,138 of the cam 130. Other types of structure to limit the rotation of the cam 130 may also be applied in the invention When the cam 130 is in the position as shown in FIG. 4B and sufficient force is applied to the left on the door 117 to stop the opening momentum of the door 117, the door 117 will remain in position absent additional forces. If the door 117 is designed to be biased toward closing, then even a slight force toward further opening the door 117 will not cause it to move until the bias is overcome. In this position, a small force will cause the door 117 to open further but a much larger force in the closing direction is required to move the strip member 116 to the position as shown in FIG. 4A. The magnitude of this force is determined by the geometry of the cam profile portions 134 and 135, the magnitude of spring force 150 and by the coefficient of friction between the strip member 116 and support member 160.

A slight drag must be exerted onto the strip member 116 by the cam surface profile 136 if the cam 130 is to be engaged by the strip member 116 and caused to rotate without slipping to bring the cam 130 to the position shown in FIG. 4A from the positions shown in FIG. 4B or FIG. 4C. The required magnitude of this drag is determined by the coefficient of friction between the strip member 116 and cam surface profile 135 which determines the point of contact between the strip member 116 and cam profile portion 135. A detailed mathematical analysis of this mechanism appears in Appendix 1. This drag is created by the action of the elastica springs 140 that will now be described.

An elastica spring was chosen for its simplicity. Many other types of springs or combinations of springs and other mechanisms such as cams and linkages could also be designed to perform the desired function. The preferred function for the spring 140 is one that exerts little or no torque on the cam 130 when the cam 130 is in the position as shown in FIG. 4A. As the cam 130 rotates from this position, the spring 140 should exert a force that opposes the motion of the cam 130 and reach a maximum value at some angle between the positions shown in FIGS. 4A and 4B, or FIGS. 4A and 4C at which point the torque should again decrease to where it reaches a value at the positions shown in FIGS. 4B and 4C determined as that required to provide the desired friction drag opposing the motion of the door. This is the preferred torque function and typically results in the greatest difference in cam radii from the locked to the unlocked positions and thus the widest manufacturing tolerances. Naturally, other functions will also work in some designs such as one where a constant torque is applied opposing the motion of the cam away from the position as shown in FIG. 4A, or, a torque function which only applies a torque in or near the positions shown in FIGS. 4B and 4C and is zero everywhere else.

An elastica spring is a spring that acts like a buckled column where when both ends are freely supported, the force does not increase significantly with greater deflection once a minimum deflection is obtained. In the cantilevered implementation used here, the force will increase with increased deflection. As best seen in FIG. 4A, each elastica spring 140 is made from a flat strip of metal and is attached at end 142 by welding or other suitable attachment means to tab 182 which is bent out of a plate forming part of cam holder 180. End 143 of spring 140 rests against cam profile portion 137 in the position shown in FIG. 4A. As the cam 130 rotates toward the position shown in FIG. 4B, end 143 of elastica spring 140 (on the left) engages tab 138 of cam 130 and exerts a torque onto the cam 130. This torque is very small or zero until tab 138 engages end 143 and begins bending spring 140 toward the shape as shown in FIG. 4B. The torque first increases as the elastica spring 140 is compressed but then decreases as the line of force of the elastica spring 140 onto cam 130 approaches a line drawn between support 142 and the cam shaft 132 center. If the cam 130 were permitted to rotate further, the torque would go through zero and begin increasing in the opposite direction, counterclockwise in FIG. 4B or clockwise in FIG. 4C. Since this is not desirable, the rotation of the cam 130 is limited as described below. A detailed mathematical analysis of the forces and torques appears in Appendix 1.

The checking mechanism as illustrated here has been designed for a coefficient of friction of about 0.1 or greater between the cam profile surfaces 135, 134 and the strip member 116. As long as the friction coefficient exceeds this value, the strip member 116 will not slip on the cam 130 and the torque chosen will not cause the cam 130 to slip on the strip member 116. The mechanism can be designed for a lower friction coefficient such as about 0.05 with the result that the tolerances on the parts would become tighter which would increase the manufacturing cost. An alternate preferred design that can be used even when lubrication is present will be described below. Most material combinations exhibit a friction coefficient of greater than about 0.1 providing the surfaces are not contaminated with a lubricant. The possible presence of a lubricant can be compensated for by providing a slight texture to the cam profile portion surfaces 134 and 135. Since there will only be rolling contact between surface 126 of the strip member 116 and the cam profile portions 134 and 135, such a texturing will not cause undue wear to the strip member surface 126. In order to reduce noise, the surface of strip member 116 is preferably made of a plastic such as a filled Nylon or with Milon by DuPont, or a similar polymer. In some applications, an elastomer may be used and in others brake material can be used. A properly designed and made textured surface will defeat the lubricating action of most lubricants by cutting through the surface lubricant film or forcing the lubricant to flow out of the space between the contacting surfaces.

A coil spring 150 is illustrated to create the contact pressure between the cam 130 and strip member 116. Naturally, other types of springs could be used including those made from an elastomer or from a cantilevered beam.

Figure 5:
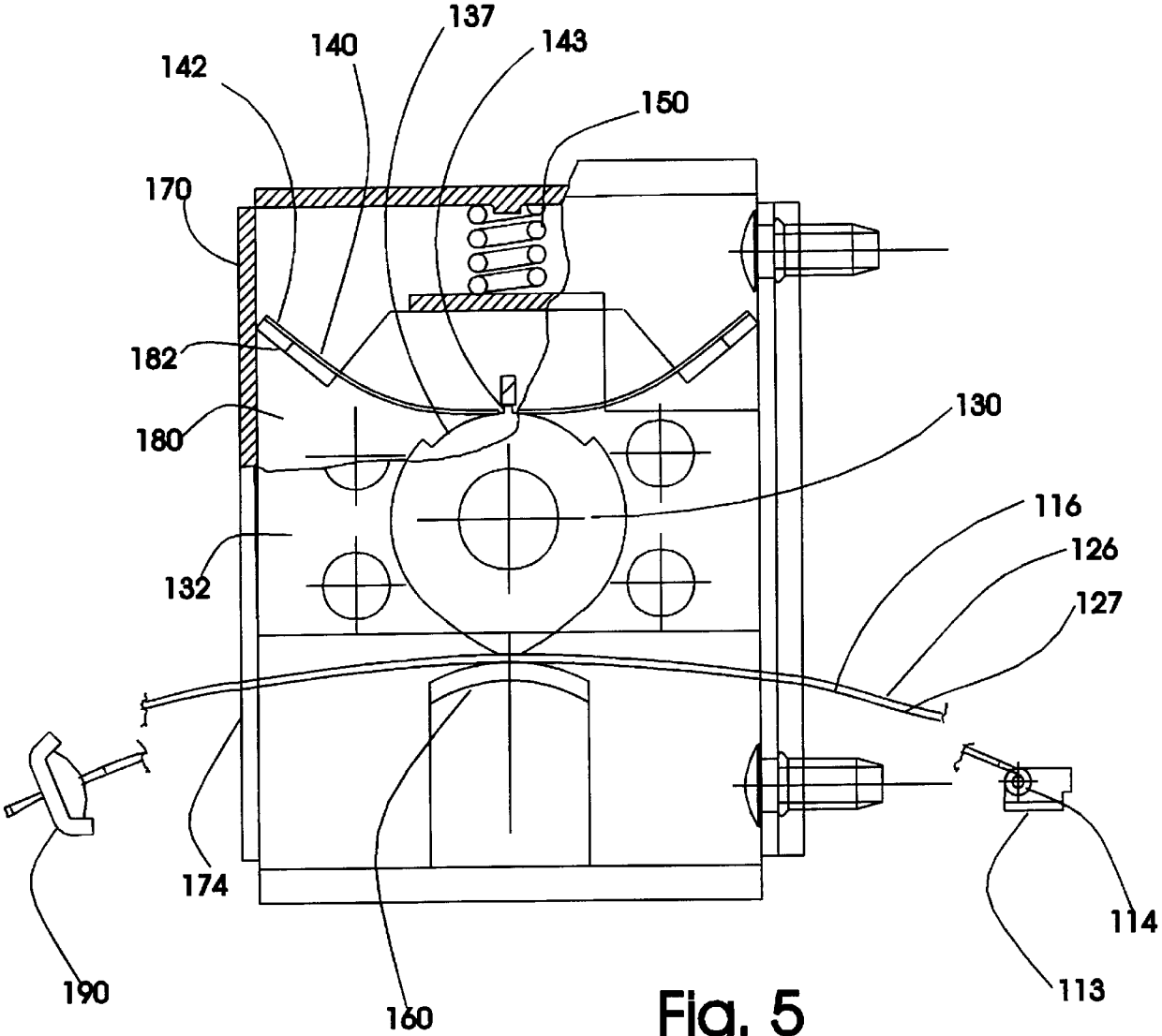
FIG. 5 is a partially sectional plan view of a vehicle door check mechanism constructed in accordance with one embodiment of the invention, with the door partially open and the cam in the full detenting position.

The mechanism described above is illustrated in an exploded view in FIG. 3 and in cross section in FIG. 5. Like reference numbers represent the same parts in each of the views in FIGS. 1, 2, 3, 4A, 4B, 4C and 5.

Checking device 118 includes an external box-like housing 170 which is closed by a cover 176 both of which may be formed of sheet metal and mounted upon door support element 119 by bolts, screws or other fasteners 123. The configuration of housing 170 is not particularly critical. Housing 170 does include two apertures through which the strip member 116 passes. The fastening means 121 connects the housing 170 to the structure to which the door check mechanism 118 is mounted. The housing 170 provides a firm mounting for the cam 130 and cam holder 180. Cam 130 is preferably made by a powder metal or forging or coining technology. Cam holder 180 can also be made from sheet metal. Cam 130, as shown in detail in FIG. 3, may comprise a central shaft 132 on which a bushing member (not shown) is mounted. This bushing member is preferably a precision molded element of relatively hard plastic and may, for example, be formed of heat stabilized, 33% glass-fiber-filled 6—6 nylon or of an aramid fiber reinforced, lubricant impregnated polyfluoroethylene terephthalate (PTFE) resin. Naturally, other materials can be used but those described here tolerate the temperatures associated with the painting of the vehicle door and with the lowest service temperatures likely to be encountered.

The use of metal for the cam 130 and support 160 is predicated upon the assumption that strip member 116 and its surfaces 126 and 127 are formed of a hard, durable resin material such as nylon, so that when the two engage each other, as seen in FIGS. 2–5, the engagement will be that of two dissimilar materials. Of course, if strip member 116 is formed of steel or other metal, then the external surface of cam 130 and support 160 are preferably made of a relatively hard precision molded resin such as heat stabilized glass fiber-filled 6/6 nylon or aramid-fiber-filled PTFE. Alternately, brake material may be used for the surfaces for some applications.

In explaining the operation of vehicle door check mechanism 118, it is most convenient to start from the closed position of door 117. In the closed position, the cam 130 is most likely to be in the position shown in FIG. 4C. To open the door 117, the cam 130 must be rotated past the detented position illustrated in FIG. 4A to the position shown in FIG. 4B. This requires that sufficient force be applied to the door to go through this detent position. In some applications, it may be desirable to eliminate this checking operation during the initial door opening operation. This can be accomplished by removing or thinning the center part of the strip member 116 so that the cam 130 can move to the position where the spring 150 forces edge 181 to engage edge 172 without the cam 130 engaging the strip member 116. This either requires that the strip member 116 be made thicker overall or that the center portion of the strip member 116 adjacent the vehicle support 104 be removed entirely.

To open door 117, the door latch (not shown) is released and the door 117 is pivoted toward an open position with respect to car body 101 and particularly its frame member 104. The direction of this movement is counter clockwise about hinge axis 125, viewed from above. This pivotal movement of the door 117 drives door check mechanism 118 along strip member 116, in the direction generally indicated by the arrow B in FIG. 4B, and compels strip member 116 to pivot about axis 114 of clevis 113. This movement continues, as the door proceeds in its pivotal opening movement, until the desired position of the door has been reached or until the door is fully opened and door stop 190 engages wall 174 of housing 170 (FIG. 5). Door stop 190 is arranged on strip member 116. If the desired position is less than full open then the door 117 will remain in that position absent an additional force to further open the door 117. If the door motion is reversed slightly, the detent will engage as shown in FIG. 4A and the door 117 will remain in that position until a significant force is applied in either direction as described above.

To close door 117, of course, it is pivoted back toward body 101 and frame member 104 (FIG. 1). On the return motion, if desired, door 117 can again be stopped and held at any intermediate position by applying a force in the opening direction until the detent is engaged.

The cam 130 is preferably solid steel providing that the strip member 116 has a polymeric or other non-metallic coating. If the strip member 116 has instead a metallic surface then the cam can be molded of a hard, relatively non-resilient plastic such as a glass-fiber-filled heat stabilized nylon or otherwise have a non-metallic surface. The purpose, as before, is to assure that where the cam surfaces 134, 135, the support surface 160 and the strip surfaces 126,127 engage there are dissimilar materials, avoiding any tendency toward "freeze-up" in operation or unnecessary noise. Also, lubrication is not generally required except on the cam shaft 132. In some applications it may be possible to use metal for both the surfaces of the cam 130 and strip member 116 providing consideration is provided elsewhere to acoustically dampen the resulting noise.

In part due to the distortable nature of the can 130 (FIGS. 2–5) or the track member (FIGS. 6,7 discussed below) and to the use of different engaging surfaces on the cam and track members, permanent lubrication, as with the use of lubricant impregnated roller shafts or bearing members may be employed, but may be unnecessary in at least some instances.

Figure 6A:
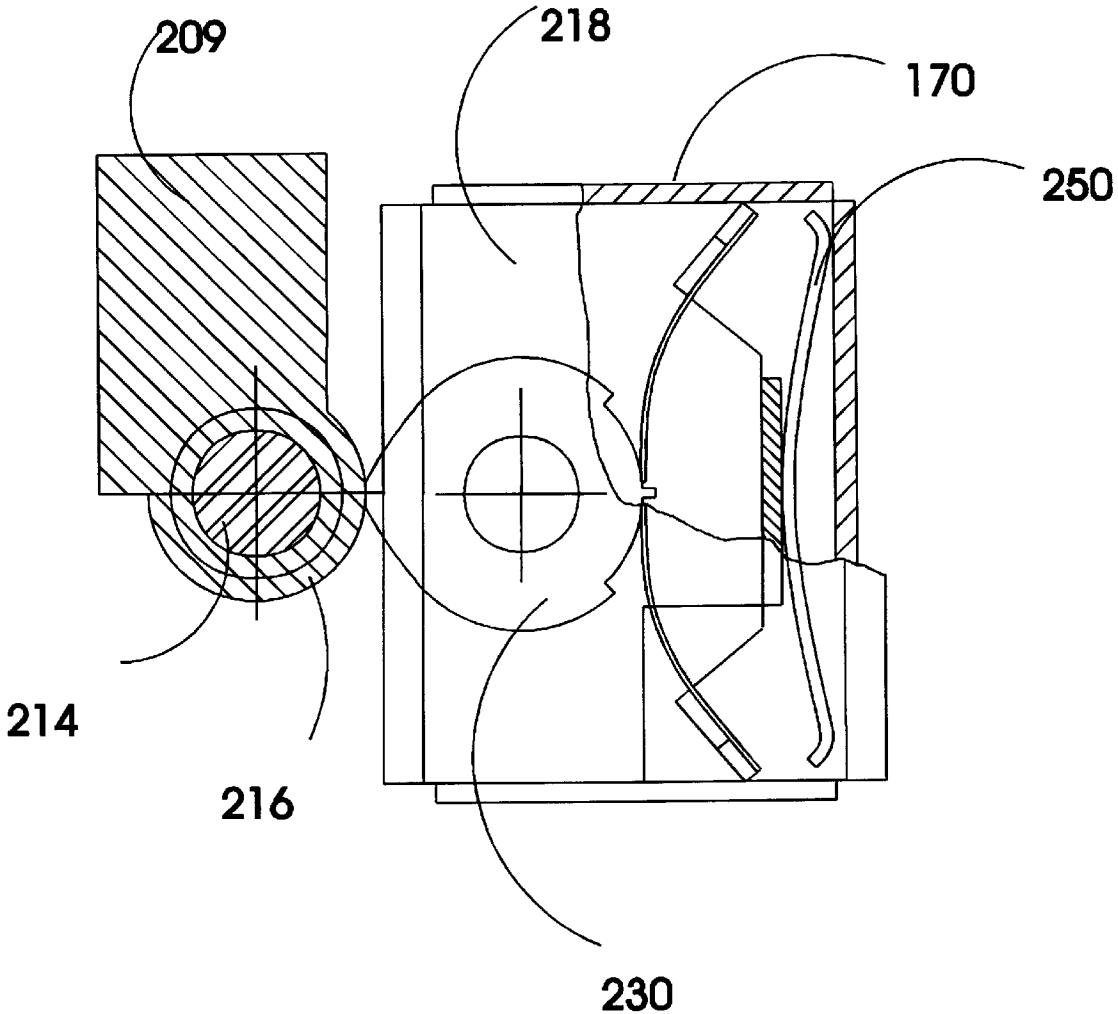
FIG. 6A is a detail view, partly in cross section of another preferred embodiment of this invention of an infinite door check mechanism made integral with the vehicle door hinge with the door shown in the closed position and where the compliance is part of the cam support structure.
Figure 6B:
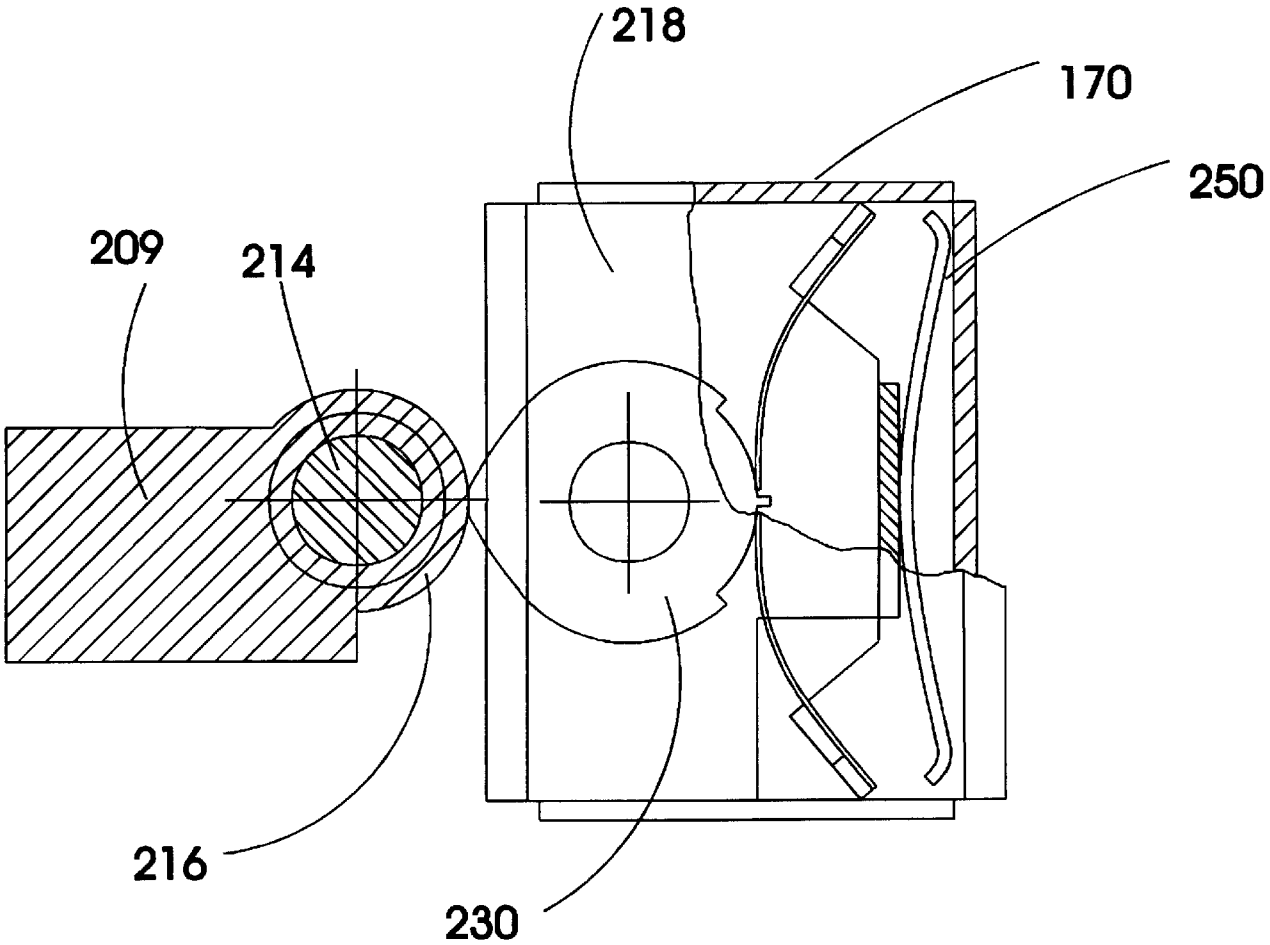
FIG. 6B is a detail view, partly in cross section of the embodiment illustrated in FIG. 6A with the door shown detented in a partially open position.

The preferred embodiment illustrated above is for the case where the checking mechanism is separate from the hinge. Naturally, the infinite door check mechanism of this invention can be integrated into the hinge itself as is common in the prior art with fixed detect door checks. One example of such a mechanism is illustrated in FIGS. 6A and 6B which are views, partly in cross section, of another preferred embodiment of this invention, of an infinite door check mechanism made integral with the vehicle door hinge with the door shown in the closed position in FIG. 6A and in the open position in FIG. 6B. The operation of this implementation is analogous with that of FIGS. 1–5 above and therefore will not be described in detail. In this embodiment, member 209 is attached to the vehicle A-pillar and rotated about hinge pin 214 defining a rotational axis. An additional part of the hinge mechanism, not illustrated, attaches the door to a hinge member 216 so that checking mechanism 218 also rotates about hinge pin 214. During the rotation of the door relative to the A-Pillar, cam 230 engages the outer circular surface of hinge member 216 in a manner similar to which cam 130 engages strip member 116 in the embodiments of FIGS. 1–5. The cam 230 is illustrated in the locking position in both FIGS. 6A and 6B.

A strip of bent spring material 250 is used in this embodiment instead of the coil spring 150 to force the cam 230 against the outer surface of hinge member 216. Although other constructions of biasing means for forcing the cam 230 against the outer surface of hinge member 216 are possible, this design was selected to reduce the space required for the checking mechanism.

Figure 6D:
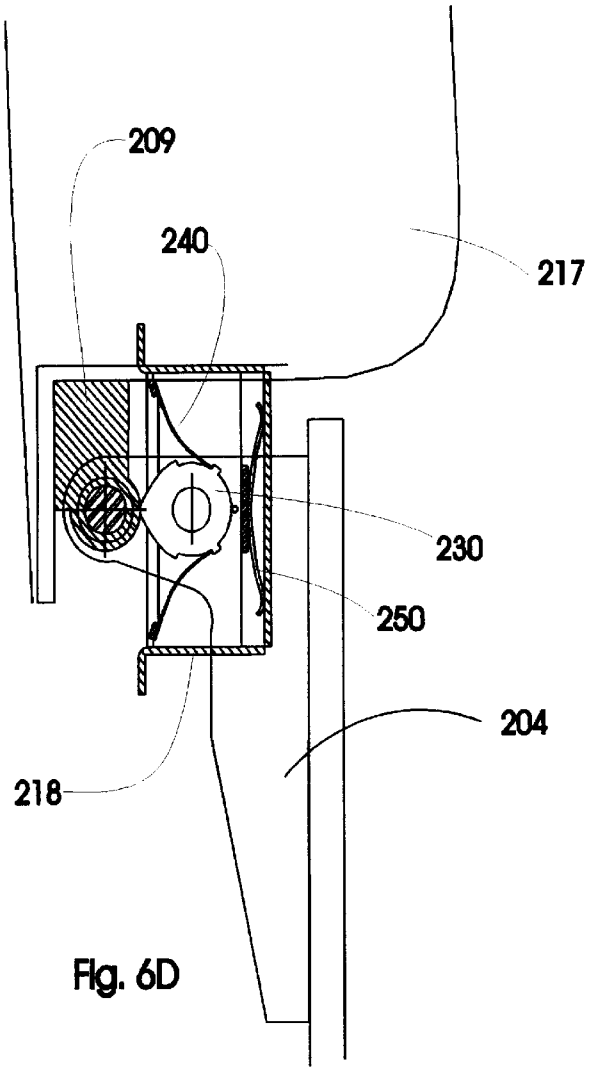
FIG. 6D is a view of the design of FIG. 6C with the door in the closed position.
Figure 6C:
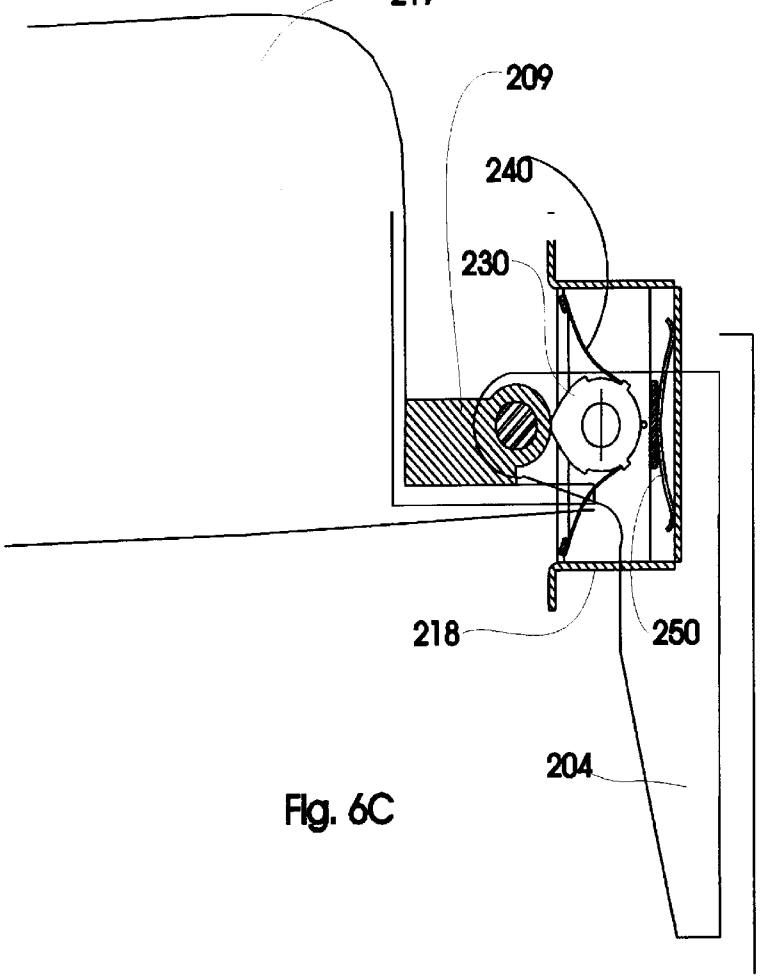
FIG. 6C is a cross section view of an alternate thinner design of the mechanism of FIG. 6A and 6B with the vehicle and door check supporting structures shown in outline with the door in the open and checked position.

A variation of this design is illustrated in FIGS. 6C and 6D where the checking mechanism 218 has been attached to the vehicle A-Pillar 204 and member 209 has been attached to the vehicle door 217. In this case, the location of the elastica springs 240 has changed to further reduce the thickness of the door check mechanism 218.

Figure 7:
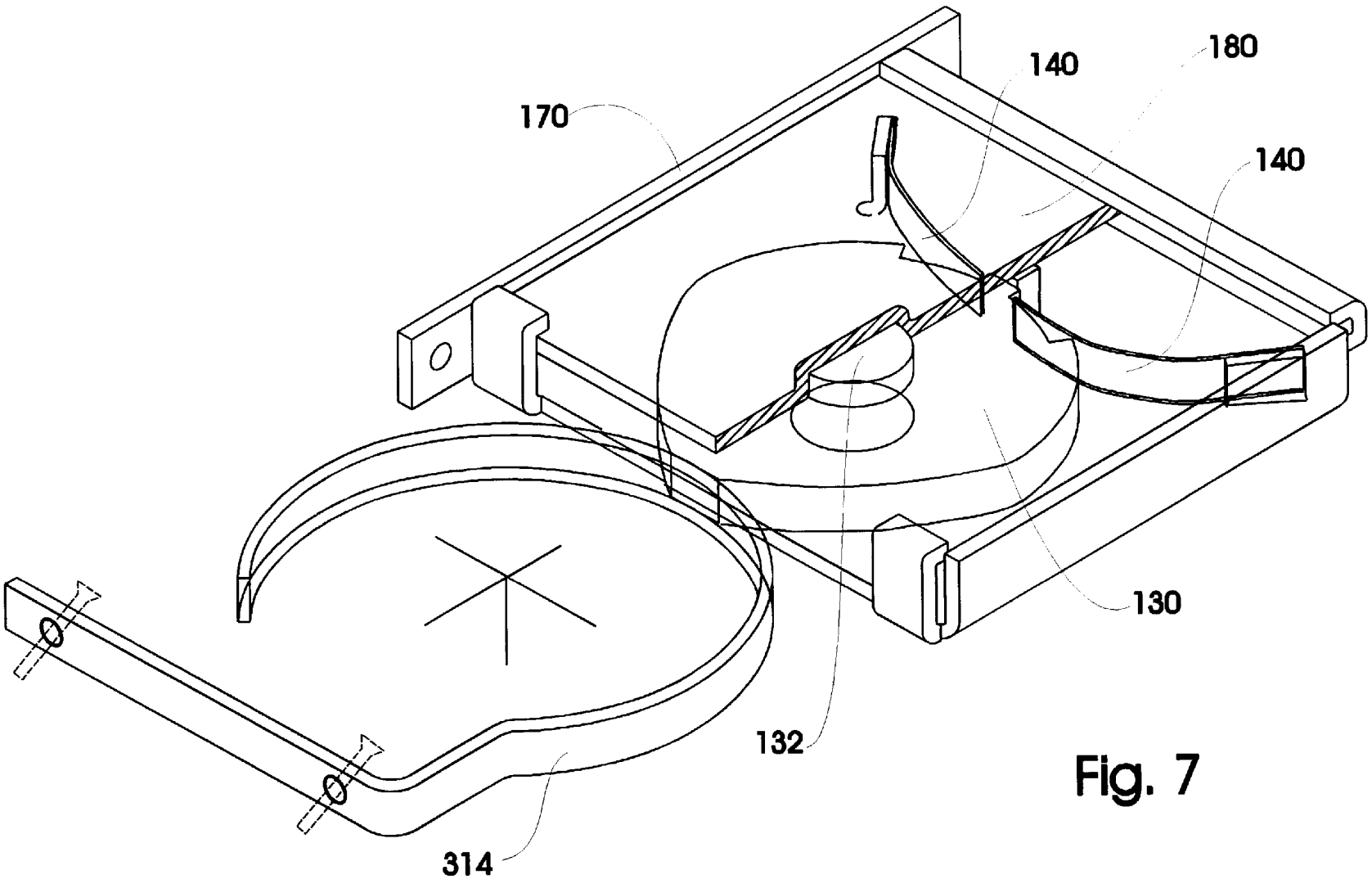
FIG. 7 is a detail view, partly in cross section of another preferred embodiment of this invention of an infinite door check mechanism made integral with the vehicle door where the compliance is part of the strip support structure.

FIG. 7 is a detailed view, partly in cross section of another preferred embodiment of this invention of an infinite door check mechanism made integral with the vehicle door where the compliance is part of the strip support structure. Strip 314 is preloaded against cam 130 that performs similar functions as in the embodiments described above.

Figure 8:
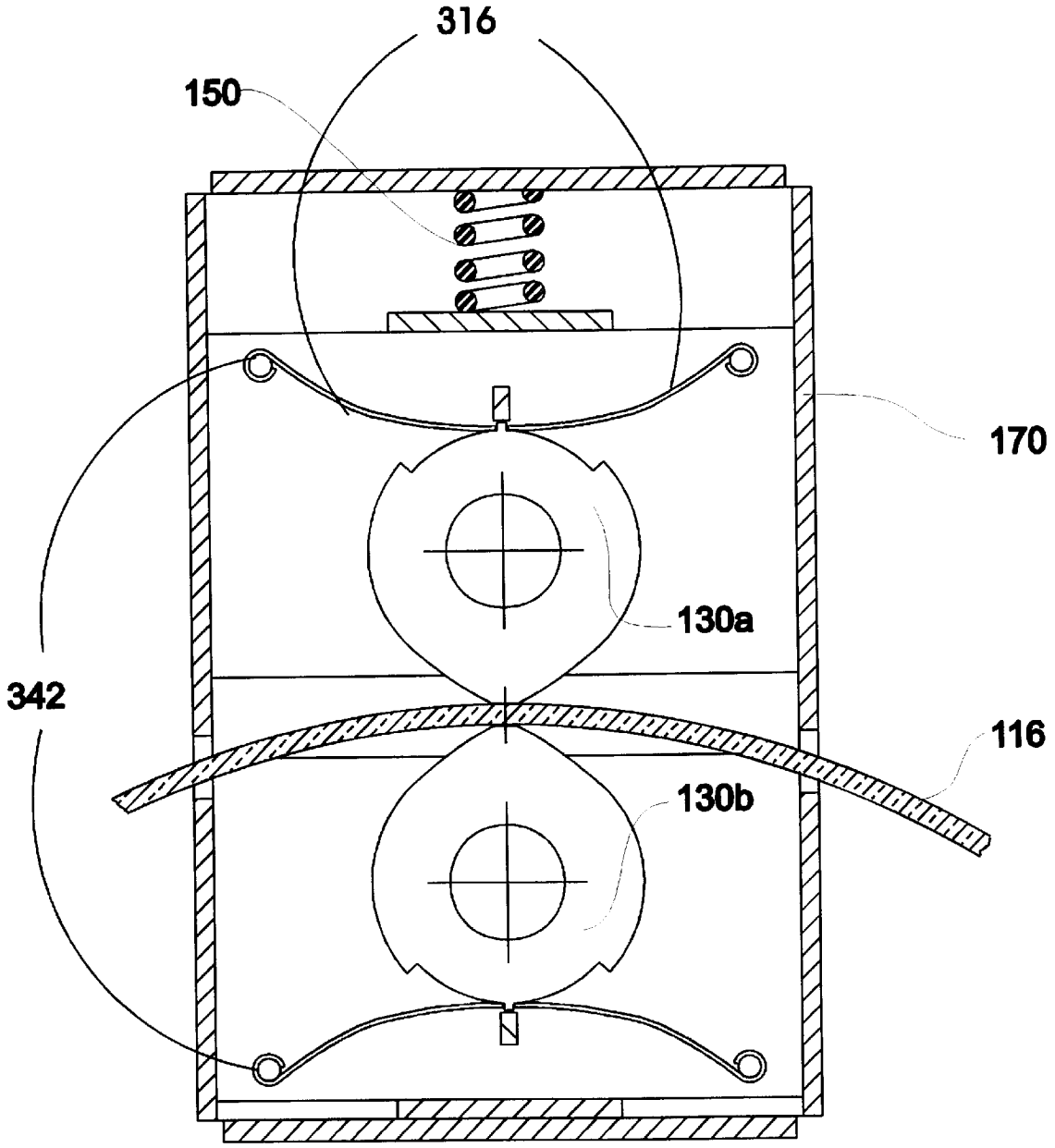
FIG. 8 is a cross section view of another preferred embodiment of this invention where two opposing cams are utilized.

In some implementations where there is sufficient space, two opposing cam mechanisms 130*a*, 130*b* can be used in place of the single cam structure as described above as illustrated in FIG. 8 which is a cross sectional view, each cam mechanism 130 being essentially as described above. In such cases, the door check mechanism will generally be mounted in a vertical plane instead of the horizontal plane illustrated in FIG. 1. In this implementation, elastic springs 316 are shown in a pivoting arrangement about supports 342. This two cam implementation has the advantage of reduced wear since the strip member 116 is not sliding on a support member such as 160 in FIG. 2. In this embodiment, there is only a single spring 150 which is sufficient to exert pressure forcing cam 130*a* against the strip member 116 which is pressed against cam 130*b* thereby securely retaining the strip member 116 in a fixed position.

Figure 9:
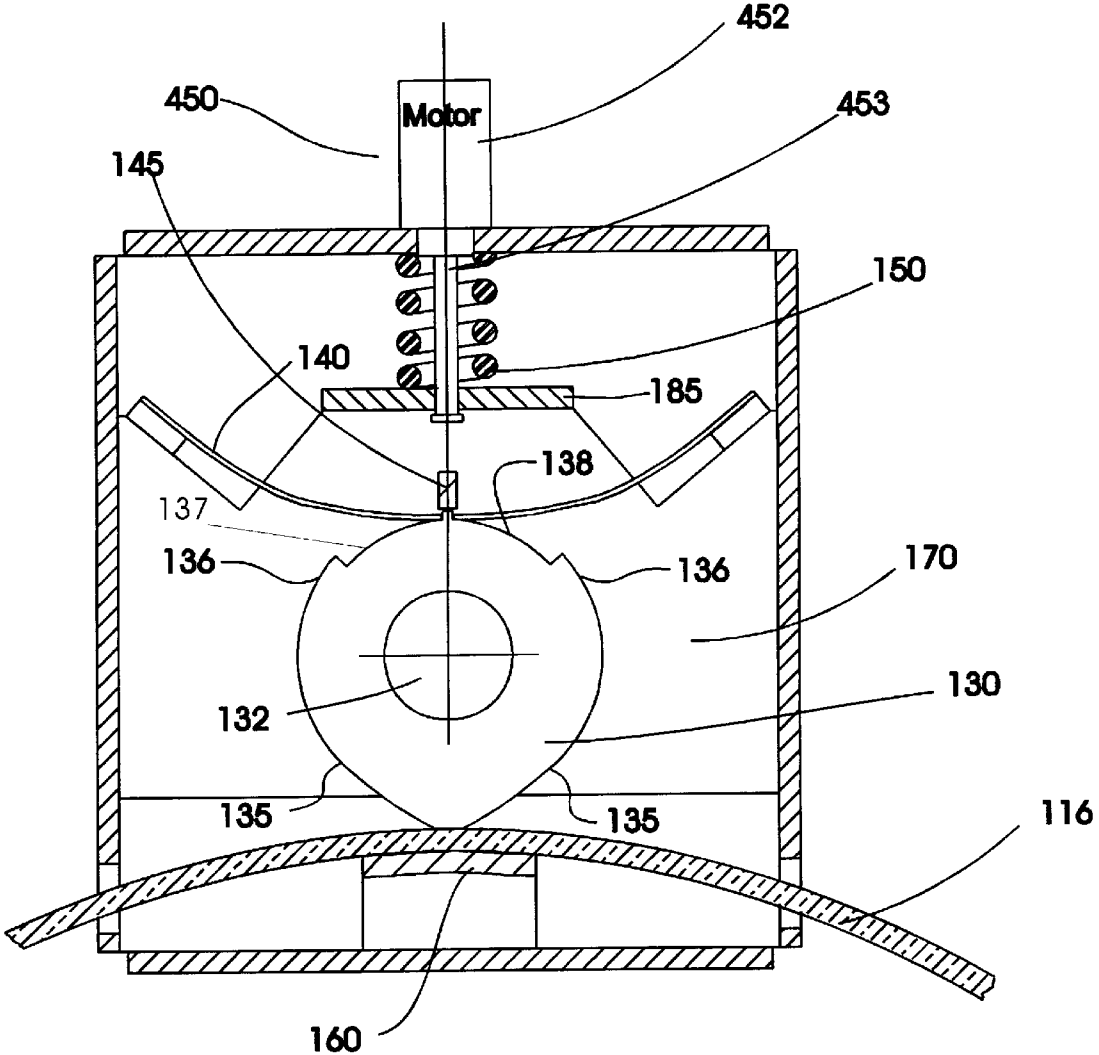
FIG. 9 is a cross section view of the mechanism of FIGS. 1–5 with the addition of an electrically operated release mechanism permitting the door to automatically close under its own weight.

A common complaint among older and disabled people is that once they are in the vehicle and the door is detented open, closing the door can be a difficult chore. What is desired is a feature where with the push of a button, the door will close automatically. This feature can be readily added to the instant invention as shown in FIG. 9 that is a cross section view of the mechanism of FIGS. 1–5 with the addition of an electrically operated release mechanism 450 permitting the door to automatically close under its own weight.

In many cases, doors are designed to be gravity biased to close automatically except for the detenting system. If the detent can be removed in these cases, the door will close automatically under its own weight unless the vehicle is tilted significantly to the side or pointing down a hill. An electrical release mechanism 450 is illustrated in FIG. 9 which utilizes actuation means such as a motor 452 to pull on rod 453 which extends through a cam support bracket 185 by overcoming the force of bias spring 150 and thus cam 130 is moved from engagement with strip member 116. Cam support bracket 185 is a part of cam holder 180. With the detenting and friction forces absent, strip member 116 can move freely and the door closes under its own weight. Motor 452 can be a conventional electric motor acting through a worm gear or similar motion converter, a conventional stepping motor, a thermoactuating motor such as used for some windshield wiper motors using thermoactuating polymers made by the Hoechst Celanese Corporation, or through the use of thermo-actuating wire such as Flexinol™0 made by Dynalloy Inc.

Figure 10:
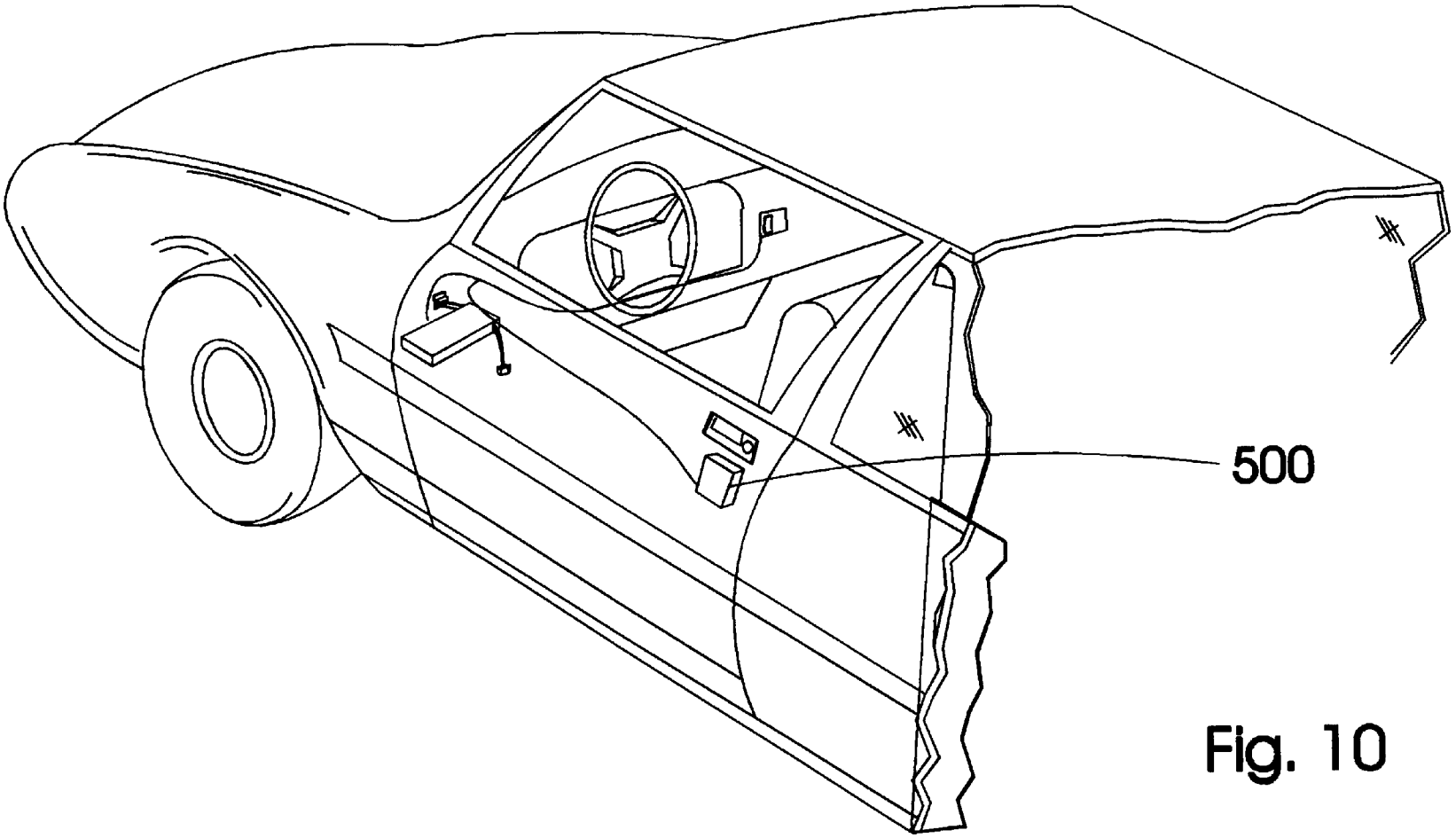
FIG. 10 illustrates an electrically operated door final close mechanism which can be used in combination with the electric release of FIG. 9 to provide for complete door closure.

Usually, the momentum of the door closing as described is insufficient to fully close the door and an additional mechanism is required for pulling the door to its completely closed and latched position. Such a device is illustrated schematically as 500 in FIG. 10. Naturally, although FIG. 10 illustrated the mechanism for the driver door, it can be applied to all of the vehicle doors. Thus using one or more switches, the driver of the vehicle can close all of the vehicle doors automatically. In some cases, it might be desirable to additionally provide for an electric motor door closing mechanism so that the door will close even when the vehicle is parked on a hill.

Figure 11:
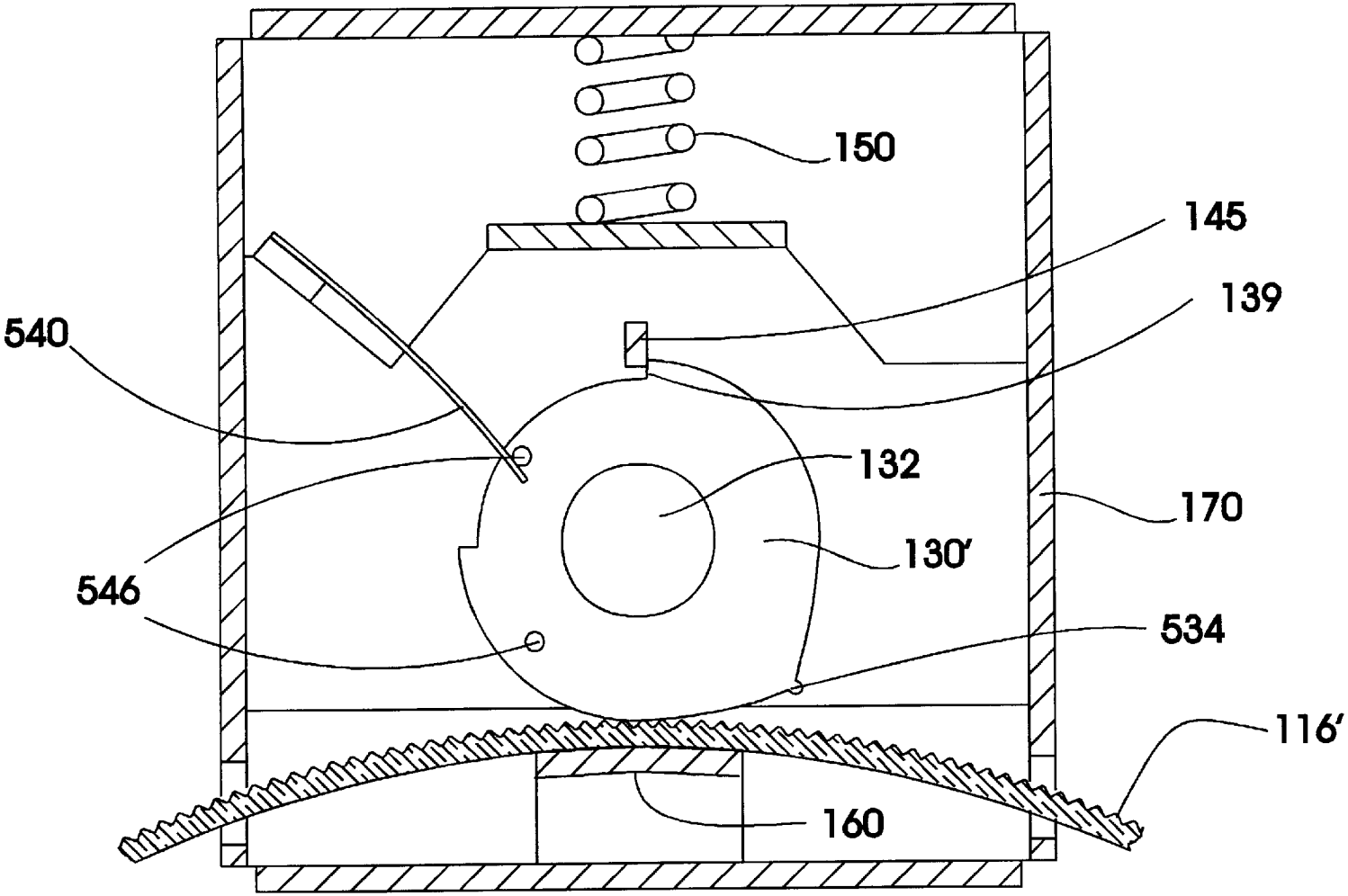
FIG. 11 is a cross section view of the mechanism of FIGS. 1–5 modified to increase the drag of the cam on the strip thereby preventing the door from swinging freely and also incorporating a serrated surface on the strip to increase the effective friction as the strip engages a point on the cam.

The invention as implemented in FIGS. 1–4 above, utilized an elastica spring system which was designed to have a torque function which started at zero in the fully checked position of FIG. 4A increased and then decreased to a low value as the cam moved toward the positions shown in FIGS. 4B and 4C. This design is useful when there is sufficient drag in the door hinges to prevent the door from swinging freely. Without some damping caused by friction drag, the door would not have the customary "feel". One way to add drag to the mechanism of this invention is to maintain a significant torque on the cam so that it always rubs on the strip. One method of doing this is illustrated in FIG. 11 where a cantilevered spring 540 provides a torque function that increases continuously as the cam 130' rotates beyond certain limits. The end of the cantilevered spring 540 that is not mounted to the housing 170 is movable between two projections 546 on the cam 130'. As before, tab 145 interacts with edge 139 to prevent excessive rotation of the cam 130. FIG. 11 also illustrates an alternate relationship between the cam 130' and the strip member 116' where a point 534 of the cam 130' is designed to interact with a serrated surface on the strip member 116' much like a single gear tooth engaging a rack of gear teeth. In this embodiment, the coefficient of friction becomes relatively unimportant as a positive engagement is achieved.

Figure 12:
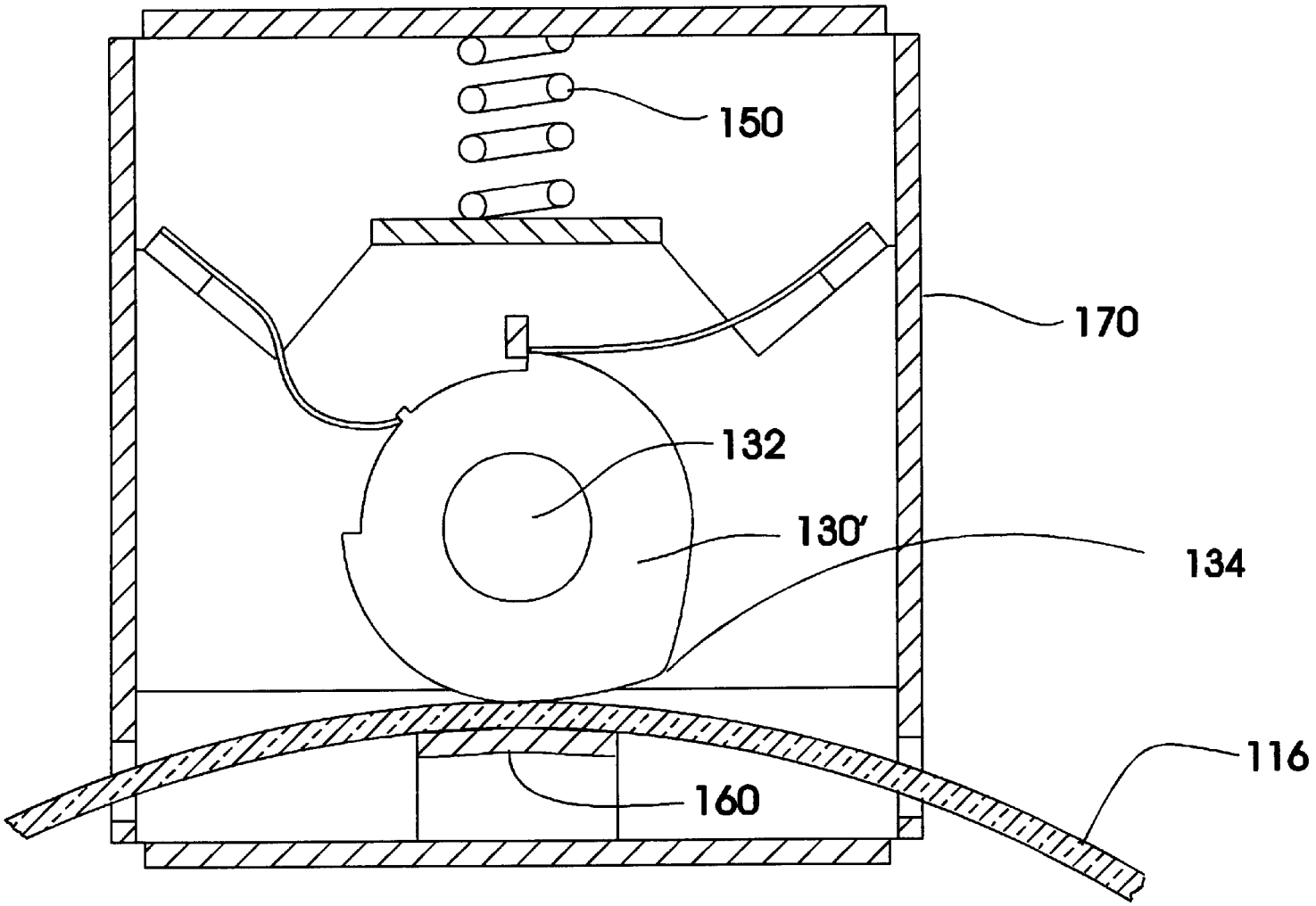
FIG. 12 is a cross section view of the mechanism of FIGS. 1–5 modified to eliminate the flat section on the cam.

In some cases, the door is so strongly biased toward closing that an intermediate checking position is not required. FIG. 12 illustrates the removal of the checking position of FIG. 4A by the reduction of the length of flat surface 134 of the cam 130 to zero length, i.e., a pointed tip. One application for this example is for cabinet doors that are spring-biased toward closing. In this case, the door can be opened to any desired degree and it will maintain that position until a reversing force is applied sufficient to overcome the checking action of the cam 130. Another application for such a design is for vertically opening doors, lids, or covers such as used for vehicle hoods and trunks, for example.

Figure 13B:
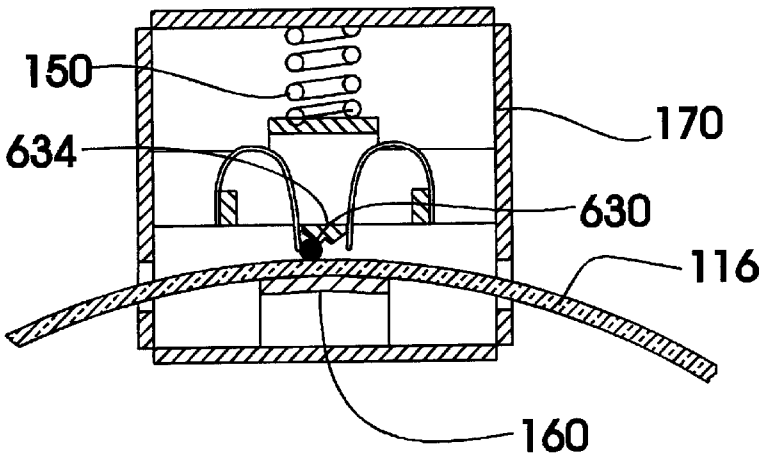
FIGS. 13A,–13F are alternate methods of practicing the teachings of this invention using other wedging mechanisms in place of the cam. (wedging roller, loop spring, 4-bar linkage)
Figure 13A:
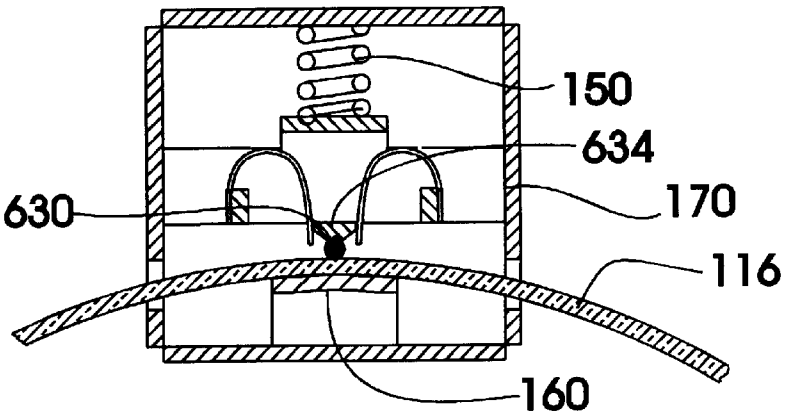
Figure 13C:
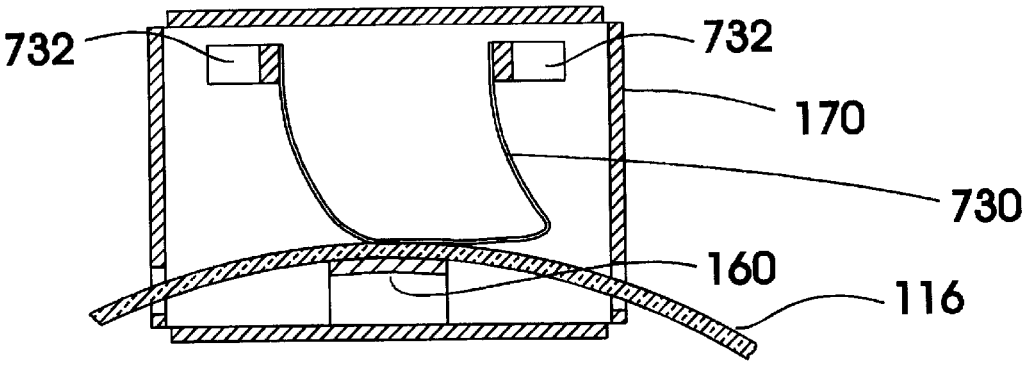
Figure 13D:
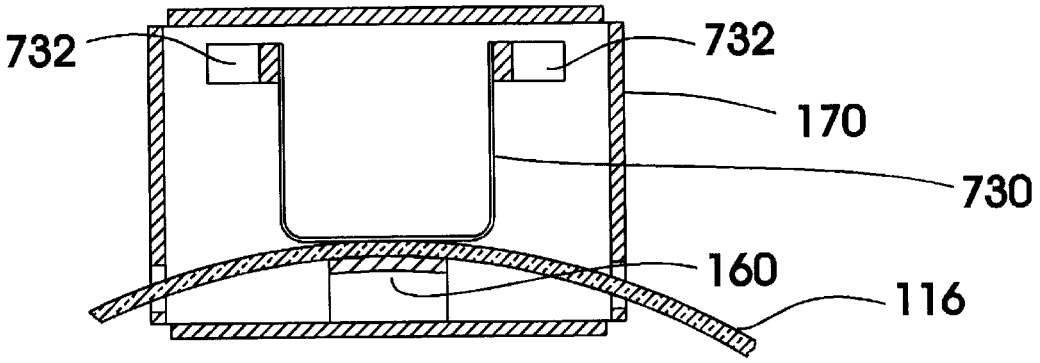
Figure 13E:
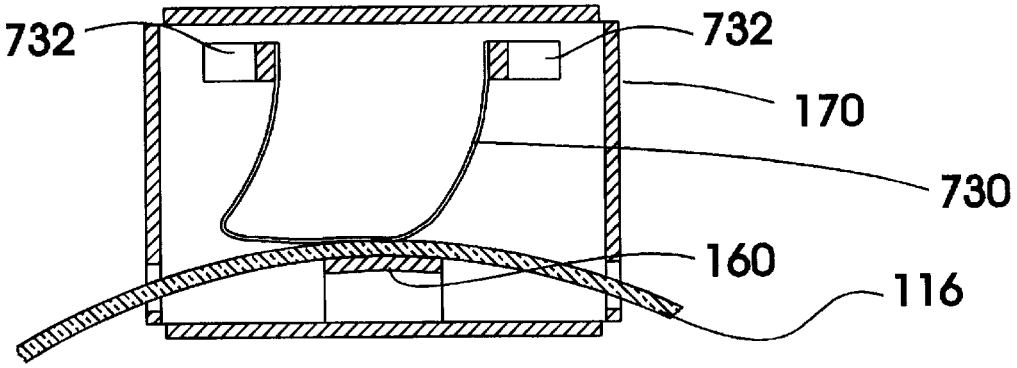
Figure 13F:
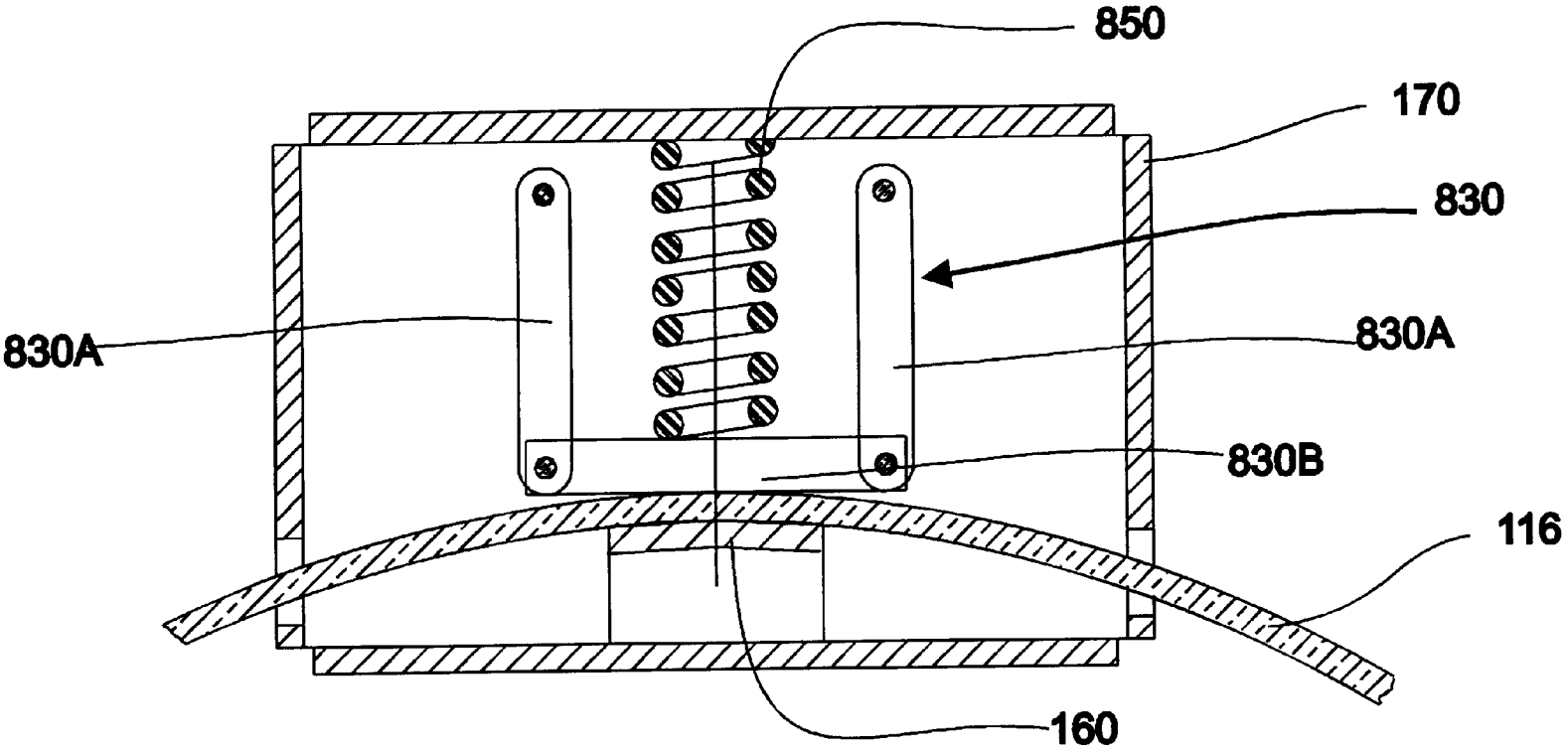
Figure 14:
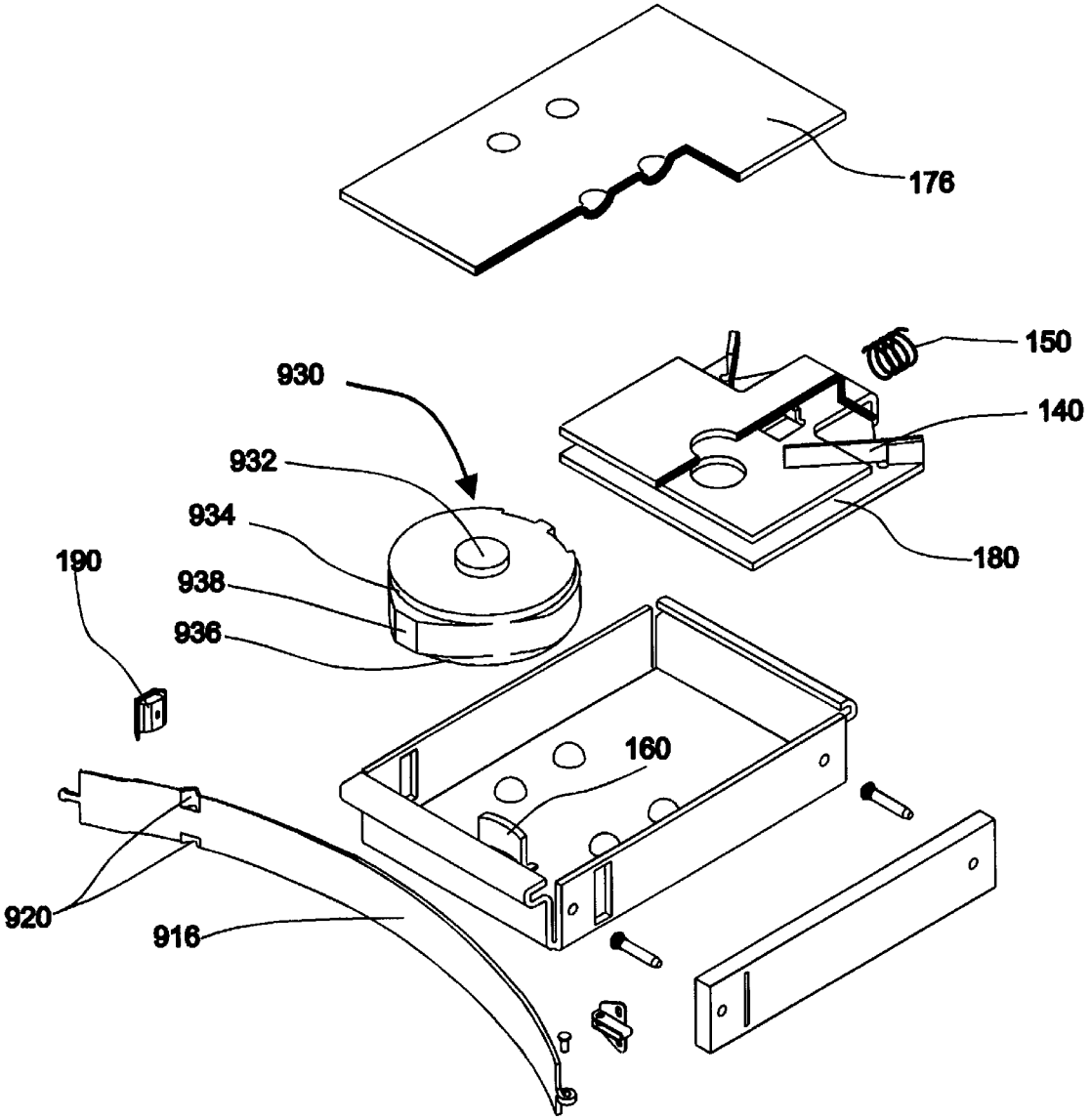
FIG. 14 is a variation of embodiment of FIGS. 1–5 illustrating the use of a fixed detent for the opening motion of the vehicle door at a partially open position.

Up until now, a cam type wedging mechanism has been illustrated. Alternate systems can also be used as illustrated in FIGS. 13A–13F. In FIGS. 13A and 13B, the principle of a roller sprag is illustrated. In an arrangement similar to FIGS. 13A and 13B, a ball can be used in place of the roller. The principle of operation is similar but the strip now contains a groove to retain the ball. A detailed discussion of the operation of the conventional sprag roller system can be found in U.S. Pat. No. 5,482,144 to Vranish which is included by reference herein in its entirety as if it all words and figures were literally inserted here. The sprag disclosed as prior art in the '144 patent has been modified here to permit a certain maximum torque to be transmitted between the driving member (strip member 116) and the driven member (member 634) by means of roller 630 before a snap through to the detent position and then to free motion in the other direction is permitted. In the normal operation of a sprag, the transmitted torque is considered infinite and no snap through feature is provided. The mechanism of FIGS. 13A and 13B is therefore not a true sprag mechanism although the principles of operation are similar. Still another wedging system is illustrated in FIGS. 13C–13E where a piece of spring material 730 is formed so as to provide easy motion of the strip to the right in FIG. 13C, a detent position when motion is reversed as shown in FIG. 13D (in which the spring 730 has a generally U-shape, followed by a free motion to the left after sufficient force has been applied to move out of the detented position as shown in FIG. 13E. The ends of the spring 730 are mounted to tabs 732 bent out of the housing 170. FIG. 13F shows a similar device where the spring 730 has been replaced by a three bar linkage 830 and a biasing spring 850. The three bar linkage 830 includes two opposed bars 830A and one transverse bar 830B. The opposed bars 830A are each pivotally mounted at one end to the housing 170 and at the opposite end, pivotally mounted to the transverse bar 830B. FIG. 14 is a variation of embodiment of FIGS. 1–5 illustrating the use of a fixed stop for the opening motion of the vehicle door at a partially open position. To this end, the strip member 916 includes projections 920 arranged at the transverse edges thereof and which extend inward toward the cam 930. The location of the projections 920 determines the degree of opening of the door at the fixed stop. The cam 930 is formed to have a central shaft 932, an upper disk 934, a lower disk 936 and an irregularly shaped section 938. The irregularly shaped section 938 may be as described above with reference to FIGS. 2–5. When the strip member 116 and housing 170 are moved with respect to one another during swinging of the door so that the projections 920 contact the upper and lower disks 934,936, the position of the door may be fixed thereat. In other respects, this embodiment is similar to the embodiment shown in FIGS. 2–5.

Figure 15:
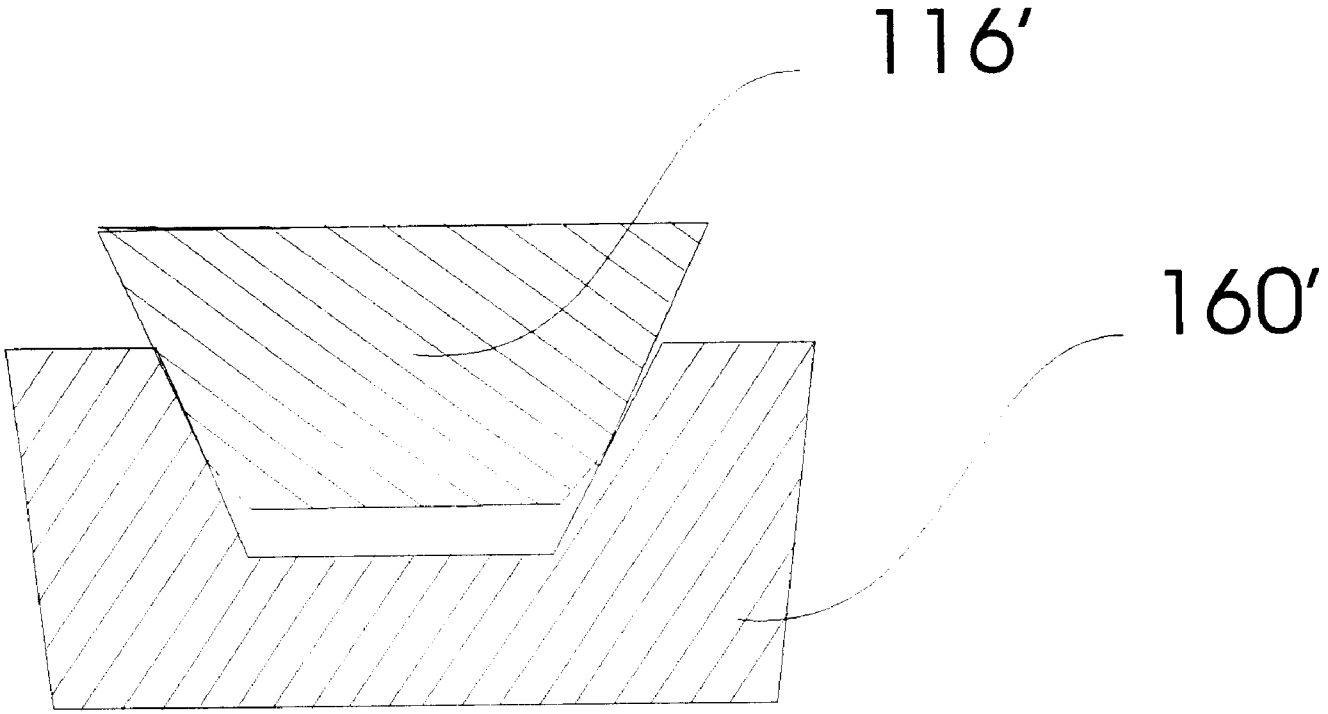
FIG. 15 illustrates another preferred embodiment illustrating the use of angled wedging contact surfaces for the strip and support.

FIG. 15 is another preferred embodiment illustrating the use of angled contact surfaces for the strip and support, in a similar manner as in the Vranish '114 patent referenced above. A similar arrangement can also be used for the cam and strip member. In this embodiment, the strip member 116' has beveled edges and the support member 160' has a groove receivable of at least portion of the strip member 116'.

Figure 16:
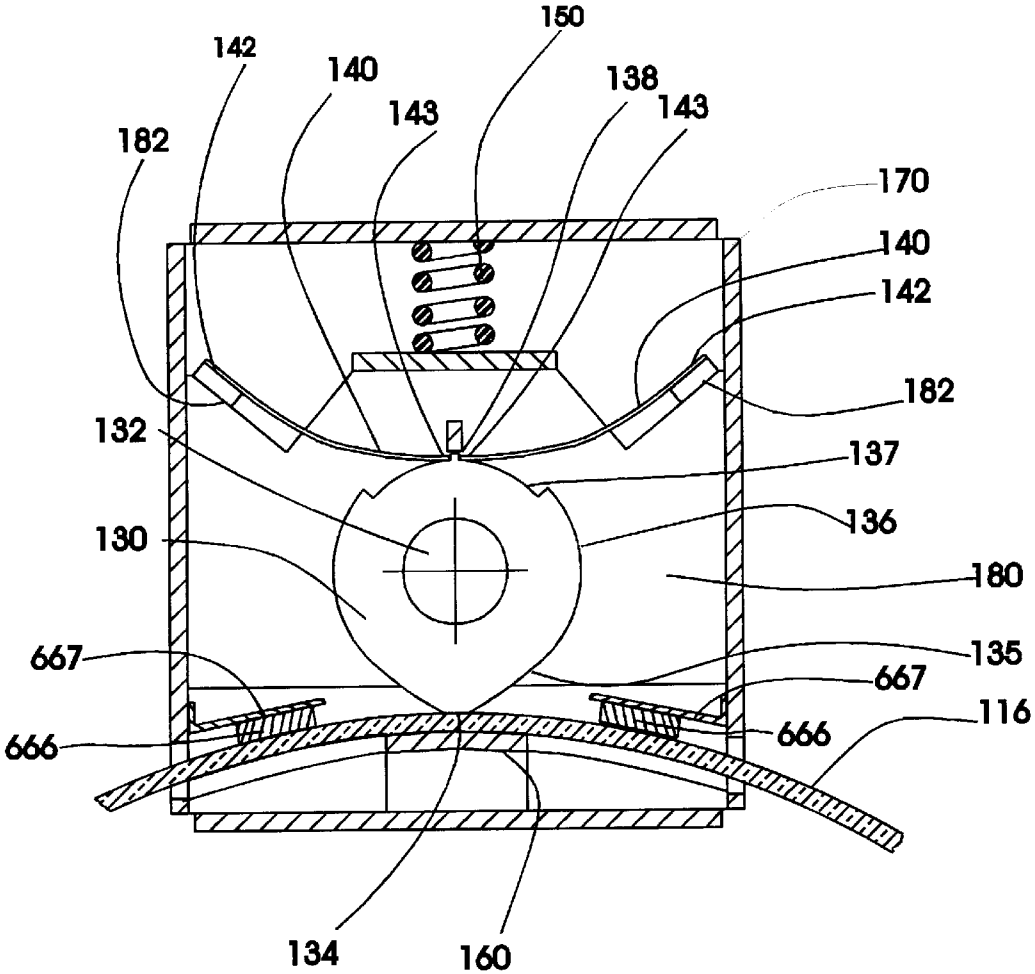
FIG. 16 illustrates apparatus for providing a drag on the door check strip so as to dampen the motion of the door when it is in the non-checked position.

FIG. 16 illustrates apparatus for providing a drag on the door check strip to as to dampen the motion of the door when it is in the non-checked position. In this embodiment, brake material 666 is pressed against strip member 116 by springs 667 mounted on the housing 170.

Figures 17A, 17B, 17C:
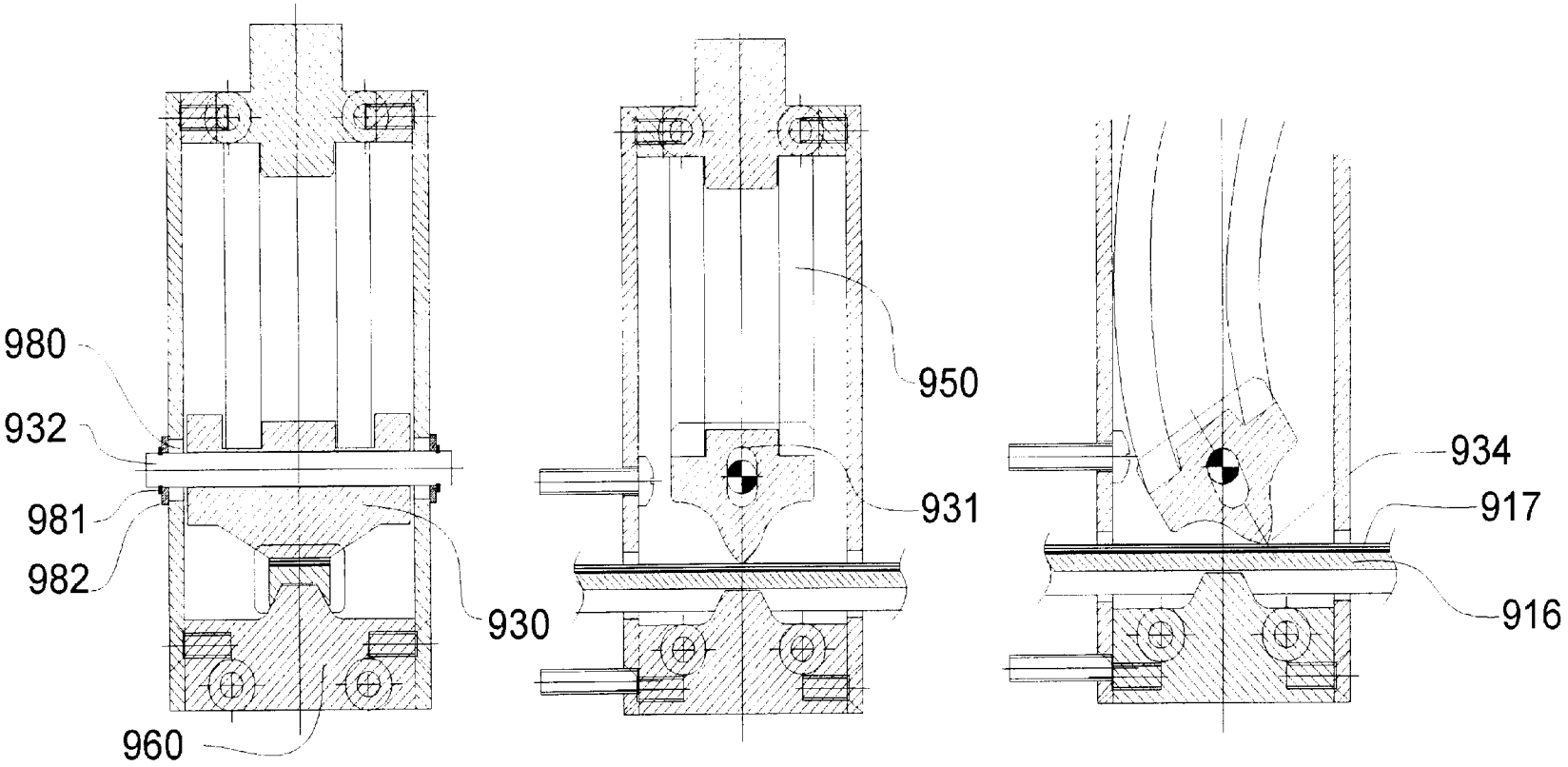
FIGS. 17A, 17B and 17C illustrate another preferred embodiment of the invention.

Several of the features of the above designs are combined in the preferred design illustrated in FIGS. 17A, 17B and 17C. The cam 930 is supported by shaft 932 and biased against the strip member 916 by biasing spring 950. Biasing spring 950 also provides the required torque on cam 930 thus eliminating the need for the elastica springs. A detained analysis of this mechanism is provided in Appendix 2. The strip 916 contains a surface made from brake material 917 on its top and contains the sprag wedging system of FIG. 15 on its lower surface which mates with a conical support member 160. The shaft 932 is retained in a hole 980 by retaining washer and retaining rings 981 and 982. The cam is thus permitted to move up and down on the shaft through the elongated groove 931. The downward motion of the cam is limited when the cam 930 reaches the bottom of groove 931 at which point the load of the cam against the strip is substantially reduced. The cam tip 934 rolls on the strip surface 917 due to the high coefficient of friction. The sprag effect between the strip and support multiples the friction drag force providing the needed checking force for the system.

In any of the various embodiments of the invention described above, the door check mechanism should afford excellent performance characteristics over the full vehicle life. These door check mechanisms provide quiet operation over the full range of door movement, require little or no lubrication and have a minimum of moving parts; they are light in weight and adaptable to use with bolts, butt welding, or virtually any other; mounting arrangement. Corrosion is effectively avoided and adjustment of operational force requirements is readily achieved.

The infinite door check mechanism in accordance with the invention may be used for doors other than vehicular doors, although its use in vehicular doors is of primary importance as the need for such a door check mechanism is most prominent in this regard. There are additionally other non-door applications for the mechanisms disclosed herein.

APPENDIX 1

Design and Analysis of Door Check Device (FIGS. 1–5)

The cam pivots about a point O. A line from O perpendicular to the strip intersects the plane of the strip at a point V, fixed in space. In the locked position, a line from O to V intersects the cam surface at a point C, fixed on the cam. Since the system must perform equally for motion of the strip in either direction from the locked position, the cam should be symmetric about the line OC. Motion of the strip to the right, with counter-clockwise rotation of the cam, will be analyzed but the results for motion of the strip to the left will be the same with some obvious changes in sign. The following parameters are defined (CW stands for clockwise, CCW for counter-clockwise):

P is any point on the cam surface, $\theta$ is the angle between OC and OP, positive if OP is CW from OC, $R(\theta)$ is the distance from O to P, Q is the point on the cam contacting the strip, once the strip begins to move, $\phi$ is the angle between OQ and OV, positive if OQ is CCW from OV, $\psi$ is the CCW rotation of the cam from its locked position, the angle between OV and OC, $\theta_Q$ is the angle between OC and OQ, $\theta_Q=\psi-\phi$, $R_Q$ is $R(\theta_Q)$, y is the distance from O to V, $y=R_Q \cos(\phi))$, $\delta y$ is the distance the pivot point O must be moved toward the strip to rest on its support and reduce the force between the strip and cam, $\xi$ is the distance from the line OV to point P, $\xi=R \sin(\psi-\theta)$, $\eta$ is the distance of P from the strip, $\eta=y-R \cos(\psi-\theta)$, F is the component along OV of the external force on the cam, $F_t$ is the component parallel to the strip of the force on the cam from the strip, positive in the direction of motion of the strip, T is the external CW torque on the cam about the pivot, $\mu$ is the design coefficient of friction between the cam and the strip; the actual coefficient of friction must be at least $\mu$, x is the motion of the strip from the locked position, w is the distance between V and Q when the strip begins to move, the subscript i indicates initial values, with the system in the locked position and the strip just beginning to move.

For a point fixed on the cam surface $\theta$ and R are fixed and as the cam rotates $d\xi=R \cos(\psi-\theta)\, d\psi$ and $d\eta=dy+R \sin(\psi-\theta)\, d\psi$. For the point instantanously at Q $d\eta=0$ and $dy=R_Q \sin(\phi) d\psi$. If the cam does not slip on the strip then $d\xi=dx$ and $dx=R_Q \cos(\phi)\, d\psi$. Thus $dy/dx=-\tan(\phi)$.

A moment balance on the cam about the point O leads to $T=F\, y \tan(\phi)+F_t\, y$. Since $|F_t|$ must be $\leqq \mu F$ the torque T must be between $T_{min}$ and $T_{max}$ where $T_{min}=F\, y\, (\tan(\phi))-\mu)$ and $T_{max}=F\, y\, (\tan(\phi)+\mu)$. Or, if T, F, y, and $\mu$ are specified then $\tan(\phi)$ must be between $T/(F\, y)-\mu$ and $T/(F\, y)+\mu$.

Note that $F_t=T/y-F \tan(\phi)$ can become negative after $\phi$ is positive. This means that the cam action is pushing the door farther in the direction of its initial motion. It might be necessary to limit this pushing action to a value $F_{tmin}$ to keep the door from getting out of control.

When the strip first begins to move it could be moved in either direction, and by symmetry the torque T must be zero. Then $F_{ti}=-F_i \tan(\phi_I)=F_i\, w/y_i$ and, for specified $F_{ti}$ and $y_i$, w should be as large as possible to minimize the required $F_i$. Since $F_{ti}$ must be less than or equal to $\mu F_i$, w must be less than or equal to is $\mu y_i$. In the design w is set equal to $\mu y_i$ and then $F_i$ is equal to $F_{ti}/\mu$.

The system is completely unlocked when the pivot O rests on its support, when O has been lowered by $\delta y$. For this to occur with as small a strip motion x as possible, $\tan(\phi)$ should be as large as possible. Initially $\phi$ is negative ($\tan(\phi_I)=-w/y_i=-\mu$), but as the strip moves $\phi$ increases: $d\phi/dx=d(\psi-\theta_q)/dx=(d\psi/dx)\,(1-d\theta_q/d\psi)=(1-d\theta_q/d\psi)/y$. Now $d\theta_q/d\psi$ cannot be negative, so to increase $\phi$ as quickly as possible $d\theta_q/d\psi$ should be zero as long as possible, that is the same point on the surface of the cam should remain in contact with the strip. This is possible if the tangent to the surface of the cam just left of the initial Q makes a positive angle with the strip. The current Q can be kept at the initial Q until $\tan(\phi))=T/(F\ y)+\mu$ or $\tan(\phi)=T/(F\ y)-F_{tmin}/F$, whichever comes first. After that the increase in $\phi$ must be controlled so that $\tan(\phi)$ does not become greater than the current value of $T/(F\ y)+\mu$ or $T/(F\ y)-F_{tmin}/F$, whichever is smaller.

$\phi$ can be controlled by controlling the curvature of the cam surface. If the contact point Q is on a portion of the cam surface with a smooth curvature, then the location of the contact point could be determined as follows. Consider again the general point P on the cam surface. If $\theta$ is varied without changing $\psi$, then y is constant and $d\eta=-dR \cos(\psi-\theta)-R \sin(\psi-\theta)\, d\theta$. At the contact point Q $d\eta$ is zero, $R=R_Q$, $\psi-\theta=\phi$, and $dR/d\theta=-R_Q \tan(\phi)$.

After the cam pivot is resting on its support, if the strip is moved farther then the strip slips under the cam and the cam does not rotate any more. The cam then exerts a normal force $F_N$ on the strip and this causes a tangential force $F_t=\mu_a F_N$, where $\mu_a$ is the actual coefficient of friction which may be greater than the design value $\mu$. A moment balance about the hinge pivot leads to $F_N=T/(\mu_a y+R_Q \sin(\phi))$ where T, y, $R_Q$, $\phi$ are the values when the pivot reaches its support.

Design steps

1. Specify the holding force $F_{ti}$, the initial distance $y_i$ of the pivot from the strip, the amount $\delta y$ that the pivot must be moved toward the strip until it is supported, the design coefficient of friction $\mu$, and the maximum pushing force $-F_{tmin}$.
2. Calculate the distance $w=\mu y_i$ and the initial external force $F_i=F_{ti}/\mu$. The initial contact point is a distance w, parallel to the strip, from the center point V. A mirror contact point is on the other side of V. The cam surface may be flat between these points or bowed away from the strip.
3. Specify an external force F(y) and an external torque $T(\psi)$. $F(y_i)$ must be $F_i$ and T(0) must be zero. After T becomes non-zero it should be positive, and should decrease as y approaches $y_i-\delta y$.
4. Initially, as the cam rotates to $\psi$, $R_Q^2=y_i^2+w^2$, $\tan(\theta_Q)=w/y_i$. $\phi=\psi-\theta_Q$, $y=R_Q \cos(\phi)$, $x=w+R_Q \sin(\phi)$, $F=F(y)$, $T=T(\psi)$, $F_t=(T/y)-F \tan(\phi)$, $T_{min}=F\, y\, (\tan(\phi)-\mu)$, $T_{max}=F\, y\, (\tan(\phi)+\mu)$.
5. This initial motion can continue until $\tan(\phi)=T/(F\ y)-F_{tmin}/F$ or $\tan(\phi)=T/(F\ y)+\mu$, whichever comes first.
6. After the initial motion is ended, the cam surface is shaped so that $\tan(\phi)$ is equal to or less than the smaller of $T/(F\ y)+\mu$ or $T/(F\ y)-F_{tmin}/F$. This is done by making $\tan(\phi)=-(1/R_Q)d\,R_Q/d\,\theta_Q=-d \log(R_Q)/d\,\theta_Q$. At a given $\psi$, the parameters $R_Q$, T, F, y, $\phi$ have been found. Then choose a new $\psi$ and
7. Calculate the new $T(\psi)$.
8. Estimate the new $\theta_Q$.
9. Calculate the new $\phi=\psi-\theta_Q$.
10. Calculate $(\tan(\phi))_{avg}\cong(\tan(\phi_{old})+\tan(\phi_{new}))/2$.
11. Calculate the new $R_Q=R_{Qqold} \exp(-(\tan(\phi))_{avg}\Delta\theta_Q)$.
12. Calculate the new $y=R_Q \cos(\phi)$.
13. Calculate the new $F=F(y)$.
14. Check $\tan(\phi)=\min[T/(F\ y)+\mu,\ T/(F\ y)-F_{tmin}/F]$.
15. Repeat steps 8 to 14 until agreement.
16. If the new $\theta_Q$ is less than the old $\theta_Q$, set the new $\theta_Q$ and $R_Q$ equal to the old values and repeat steps 9, 12, and 13 (a discontinuity of slope occurs here).
17. Continue stepping $\psi$ until $y=y_i-\delta y$. Then the cam pivot is resting on its support.
18. Calculate $F_N$ and the drag force $F_t=\mu_a F_N$ for further motion of the strip.
19. New relations F(y) and $T(\psi)$ may be specified, and steps 4 to 18 repeated to improve the design.

Two design goals are to minimize the strip travel from lock to unlock, and to minimize the final drag force on the strip after unlocking.

Analysis of torque

The torque is produced by two elastica strips mounted on either side at the top of the cam. The analysis will be for the one at the upper left that exerts the torque when the cam is rotated counter-clockwise. The other strip and its mounting are the mirror image of the one analyzed and the results are the same, with the necessary changes of sign.

In the following analysis some of the same symbols as above are used, but in most cases the meanings of the symbols are different.

The elastica has a fixed end at the upper left. If the elastica were undeformed (stress-free) it would be straight. In the locked position ($\psi=0$) the elastica is deformed so that its non-fixed end contacts the cam surface, but does not exert a torque about the cam pivot. After the cam has rotated a certain amount a projection on its surface contacts the end of the elastica, and additional rotation moves this end so that it remains in the same position relative to the cam.

Parameters

O the center of rotation of the cam,

V a point fixed in space. The line from O to V is perpendicular to the strip and directed away from the strip, F the fixed end of the elastica, $R_f$ the length of the line OF, $\phi_f$ the angle between OV and OF, E the end of the elastica in contact with the cam, $\phi_e$ the angle between OV and OE, $\phi_{ei}$ the value of $\phi_e$ in the locked position, $R_e$ the distance from the cam pivot O to point E, $\psi_T$ the cam rotation, from the locked position, at the point where the cam begins to move the elastica further, $E_\mu$ the free end of the elastica if the elastica were unstressed, $\phi_\mu$ the angle between $FE_\mu$ and a line parallel to OV, P any point along the elastica, s the distance along the elastica from F to P, x the distance FP projected along $FE_\mu$, y the distance of EP from the line $FE_\mu$, $x_e$, $y_e$ the values of x and y at E, θ the angle between the tangent to the elastica at P and the line $FE_\mu$, F the (constant along the elastica) force on any elastica cross-section, $F_x$, $F_y$, the components of F along and perpendicular to $FE_\mu$, M the moment on a cross-section of the elastica, L the length of the elastica, EI the product of the elastica Young's modulus and section area-moment, Note that when ψ is greater than $\psi_T$ $\phi_e=\phi_{ei}+(\psi-\psi_T)$ and that $\psi_T$ generally will be less than $\phi_{ei}$.

Equations $$\frac{d\theta}{ds}=\frac{M}{EI}\ \text{(From Strength of Materials)} \tag{1}$$

$$\frac{dx}{ds}=\cos\theta,\ \frac{dy}{ds}=\sin\theta\ \text{(Geometry)} \tag{2}$$

$$M=M_f+F_x y-F_y x \tag{3}$$

(Moment balance about point F; $M_f$ is the moment at F)

$$\frac{dM}{ds}=EI\frac{d^2\theta}{ds^2}=F_x\sin\theta-F_y\cos\theta \tag{4}$$

(Differentiation of 1 and 3 and use of 2)

At F, s=x=y=θ=0. At E, M=0, s=L, $x=x_e$, $y=y_e$ (Boundary conditions) (5)

The following solutions to differential equation 4 with the boundary conditions θ=0 at s=0 and M=0 at s=L may be verified by direct substitution:

$$\sin\theta=-2\sqrt{m(1-m)}\frac{F_x}{F}cd\,nd-\frac{F_y}{F}(1-2m\,cd^2) \tag{6}$$

$$\cos\theta=2\sqrt{m(1-m)}\frac{F_y}{F}cd\,nd-\frac{F_x}{F}(1-2m\,cd^2) \tag{7}$$

$$M=\sqrt{FEI}\,2\sqrt{m(1-m)}\,sd \tag{8}$$

$$\frac{F_x}{F}=2m\,cd_o^2-1,\ \frac{F_y}{F}=2\sqrt{m(1-m)}\,cd_o\,nd_o \tag{9}$$

In these equations, cd stands for the elliptic function cd(w|m), $cd_o$ for cd($w_o$|m), nd for the elliptic function nd(w|m), $nd_o$ for nd($w_o$|m), sd for the elliptic function sd(w|m). m is the parameter, a constant of integration, and w and $w_o$ are $$w=\sqrt{\frac{F}{EI}}(L-s),\ w_o=\sqrt{\frac{F}{EI}}L \tag{10}$$

Equations 6 and 7 may be integrated to get $$x=\sqrt{\frac{EI}{F}}\left[-2\sqrt{m(1-m)}\frac{F_y}{F}sd+\frac{F_x}{F}(2E-w-2m\,sn\,cd)\right]+const \tag{11}$$

-continued $$y=\sqrt{\frac{EI}{F}}\left[2\sqrt{m(1-m)}\frac{F_x}{F}sd+\frac{F_y}{F}(2E-w-2m\,sn\,cd)\right]+const \tag{12}$$

Here E stands for the elliptic integral E(w|m) and sn for the elliptic function sn(w|m). The constants in 11 and 12 may be found by requiring that x and y vanish at s=0. Then the following relations are found for x and y at the end point E:

$$\frac{x_e}{L}=\frac{1}{w_o}[2m\,sn_o\,cd_o-(1-2m\,cd_o^2)(w_o-2E_o)] \tag{13}$$

$$\frac{y_e}{L}=\frac{2\sqrt{m(1-m)}}{w_o}[sd_o+cd_o nd_o(w_o-2E_o)] \tag{14}$$

In these equations $E_o$ stands for E($w_o$|m), $sn_o$ for sn($w_o$|m), and $sd_o$ for sd($w_o$|m).

From the geometry of the system the end coordinates are $$x_e=R_f\cos(\phi_f-\phi_u)-R_e\cos(\phi_e-\phi_u) \tag{15}$$

$$y_e=R_f\sin(\phi_f-\phi_u)-R_e\sin(\phi_e-\phi_u) \tag{16}$$

Now when $x_e$ and $y_e$ are calculated, equations 13 and 14 can be used to find $w_o$ and m. Then F=EI $(w_o/L)^2$ and equations 9 can be used to find $F_x$ and $F_y$.

When $F_x$ and $F_y$ are determined the clockwise torque T about the pivot that the elastica exerts on the cam is given by $$T=R_e[F_x\sin(\phi_e-\phi_u)-F_y\cos(\phi_e-\phi_u)] \tag{17}$$

Procedure

1. Specify $R_f$, $\phi_f$, $\phi_u$, $R_e$, $\psi_T$, $(\phi_{ei}-\psi_T)$, EI.
2. Calculate $\phi_{ei}$ and $F_y/F_x=\sin(\phi_{ei}-\phi_u)$ (equation 17 with initial T=0).
3. Divide equations 9 and set equal to $\sin(\phi_{ei}-\phi_u)$ to get a relation between m and $w_o$.
4. Calculate initial $x_e$ and $y_e$ from equations 15 and 16.
5. Divide equations 13 and 14 and set to $x_e/y_e$ to get another relation between ni and $w_o$.
6. Solve the two relations to get the initial m and $w_o$.
7. From equation 13 and $x_e$ calculate L.

Now for any ψ

8. If $\psi<\psi_T$ T=0. Else $\phi_e=\psi+(\phi_{ei}-\psi_T)$.
9. From equations 15, 16, and L calculate $x_e/L$ and $y_e/L$.
10. Use equations 13 and 14 to determine m and $w_o$, for this ψ.
11. Use equations 9 to calculate $F_x$ and $F_y$.
12. Use equation 17 to calculate the torque T for this ψ.

APPENDIX 2

Analysis of Door-Check Device (FIG. 17)

The current door check device shown in FIG. 17 may be pictured as follows: it has a horizontal strip that moves with the door, while the remainder of the device is fixed to the frame of the vehicle. The bottom of the strip rubs against some backing with a coefficient of friction of $\mu_B$. The top of the strip has a prong bearing on it; at its upper end the prong rotates about a pin, and the length of the prong from its center of rotation to its contact point with the strip is L. The prong makes an angle θ with the normal to the strip. The coefficient of friction of the prong with the strip is $\mu_T$, and this is always greater than or equal to $\mu_{Tm}$. The pin cannot move horizontally, and moves vertically in a slot. It is acted upon by a spring that exerts a downward force on it. In the locked-up configuration, the prong is normal to the strip ($\theta$ is zero). When the pin moves downward a distance $\delta_P$ from the locked-up position, it is supported by the end of its slot and the spring force is no longer transmitted to the strip.

For this analysis the strip moves a distance x to the right from its locked-up configuration. Motion to the left is completely symmetric to this.

The compressive force in the spring is $F_S$. If $F_{SO}$ is its value in the locked-up configuration and the spring rate of the spring is $k_S$, then $F_S=F_{SO}-k_S L(1-\cos\theta)$, where $L(1-\cos\theta)$ is the downward motion of the pin from its locked-up configuration. Two more forces are introduced: $F_N$ is the normal force downward on the strip from the prong, and $F_T$ is the horizontal force to the left on the strip from the prong. In addition, through some mechanism, a clockwise torque T is acting on the prong at the pin. While the pin is above the bottom of its slot $F_N$ will equal $F_S$. A moment balance on the prong leads to $T=F_N L\sin\theta+F_T L\cos\theta$. The horizontal force needed to move the strip is $F_{str}=F_T+\mu_B F_N$.

In the initial motion from the locked up position the prong is required not to slip on the strip. This requires that $|F_T|\leqq\mu_{Tm}F_N$ and so $F_N L(\sin\theta-\mu_{Tm}\cos\theta)\leqq T\leqq F_N L(\sin\theta+\mu_{Tm}\cos\theta)$. During this motion $x=L\sin\theta$, $F_N=F_S=F_{SO}-k_S L(1-\cos\theta)$, $F_T=T/(L\cos\theta)-F_N\tan\theta$, and T will be some function of $\theta$ and, perhaps, $F_S$. When L, $k_S$, $F_{SO}$, and $\mu_B$ are known, then for any x successively $\theta$, $F_S$, $F_N$, T, $F_T$ and then $F_{str}$ can be calculated In the locked-up configuration where x and $\theta$ are zero, by symmetry T should be zero and $F_{str}=\mu_B F_{SO}$.

When the pin has moved to the bottom of its slot, $\theta$ has reached its maximum value, $\theta_D$, where $$\cos\theta_D = 1-\delta_P/L, \text{ and } x = x_D = L\sin\theta_D = \sqrt{\delta_P(2L-\delta_P)}.$$

Further motion of the strip requires dragging it under the prong, and then $$F_T = \mu_T F_N,\ F_N = F_{N,drag} = \frac{T_D}{L(\sin\theta_D+\mu_T\cos\theta_D)},$$

where $T_D$ is the value of the torque when the pin has bottomed out and $\theta$ is $\theta_D$, and $F_{str}=F_{str,drag}=(\mu_T+\mu_B)F_{N,drag}$. Just before the pin bottoms out the spring force and thus $F_N$ is $F_N=F_S=F_{SO}-k_S\delta_P$, and the torque T must be at least $T\geqq(F_{SO}-k_S\delta_P)L(\sin\theta_D-\mu_{Tm}\cos\theta_D)$. If the torque does not change after the pin bottoms out and $\theta$ reaches $\theta_D$, then $T_D$ will satisfy the same inequality, and the force needed to move the strip further will be $$F_{str,drag} \geq (\mu_T+\mu_B)(F_{SO}-k_S\delta_P)\frac{\sin\theta_D-\mu_{Tm}\cos\theta_D}{\sin\theta_D+\mu_T\cos\theta_D},$$

and $$\frac{F_{str,drag}}{F_{str,lock}} \geq \left(1+\frac{\mu_T}{\mu_B}\right)\left(1-\frac{k_S\delta_P}{F_{SO}}\right)\frac{\sin\theta_D-\mu_{Tm}\cos\theta_D}{\sin\theta_D+\mu_T\cos\theta_D}.$$

Note that if $T_{door}$ is the torque on the door needed to move it and if $r_{DC}$ is the horizontal distance from the center of the force $F_N$ to the center of rotation of the door hinge, then $T_{door}=r_{DC}F_{str}$. Thus if $T_{door}$ is specified for the locked position and for the continuously moving configuration, and if $r_{DC}$ is known, then the required $F_{str}$ for these configurations can be determined.

Example: suppose that L=0.5 inches and $\delta_P$=0.1 inches. Then $\theta_D$=36.87 degrees and $X_D$=0.30 inches. If the required locked-up door torque is $T_{door}$=400 inch-pounds, $r_{DC}$=2 inches, and $\mu_B$32 0.4, then the locked-up strip force must be $F_{str,lock}$=400/2=200 pounds, and the locked-up spring force must be $F_{SO}$=200/0.4=500 pounds. Suppose that $\mu_T$=0.2 and $\mu_{Tm}$=0.1. Then $$\frac{F_{str,drag}}{F_{str,lock}} \geq 1.0263\left(1-\frac{k_S\delta_P}{F_{SO}}\right),$$

and if this ratio should be, say, about 0.2, then the spring force just before the pin bottoms out must be only about 20% of the initial locked-up spring force.

Parameters:

$F_N$ normal force downward on strip from prong, $F_S$ compressive force in spring, $F_{SO}$ value of $F_S$ in locked-up configuration, $F_{str}$ horizontal force needed to move the strip, $F_T$ horizontal force to left on strip from prong, $k_S$ spring rate of spring, L length of prong from pin to strip, T clockwise torque on prong at the pin, $T_D$ the value of T when $\theta$ is $\theta_D$ and the pin has bottomed out, x horizontal motion of strip, to right from locked-up configuration, $x_D$ value of x at which the prong begins to slip on the strip, $\delta_P$ maximum travel of pin in its slot, down from locked-up config, $\theta$ angle between prong and normal to strip, $\theta_D$ maximum value of $\theta$, where the prong begins to slip, $\mu_B$ coefficient of friction between strip and backing below it, $\mu_T$ coefficient of friction between prong and strip, and $\mu_{Tm}$ minimum value of $\mu_T$.

We claim:

1. An infinite door check mechanism for enabling a door to be moved from a closed position in a door frame to any one of a plurality of different open positions, comprising a door check housing adapted to be mounted on the door, a support member arranged in said housing, a movable locking member arranged in said housing an elongate strip member adapted to be mounted to and extend outward from the frame, said strip member extending at least partially through said housing and being at least partially interposed between said locking member and said support member, biasing means for selectively pressing said locking member against said strip member to force said strip member against said support member and thereby retain said strip member in a fixed position resulting in checking of the door and releasing pressure of said locking member against said strip member and thereby enable movement of said strip member, and, torque means for applying a torque to said locking member to prevent said locking member from slipping on said strip member when the checking is occurring.

2. The door check mechanism of claim 1, wherein said strip member is arcuate and adapted to be pivotally mounted to the frame, said strip member having opposed longitudinally extending surfaces, one of said surfaces engaging said locking member and another of said surfaces engaging said support member.

3. The door check mechanism of claim 1, wherein said locking member is a cam including an integral cam shaft defining a rotational axis for said cam, said cam having an irregular shape and being arranged to press said strip member against said support member with a variable force depending on the position of said cam.

4. The door check mechanism of claim 3, wherein said cam has a first flat surface having edges and second and third arcuate surfaces alongside a respective one of said edges of said first flat surface such that the radial distance at said edges is greater than the radial distance of said first flat surface.

5. The door check mechanism of claim 4, further comprising a cam holder fixedly connected to said cam, said cam holder having an edge adapted to contact said support member once said second or third arcuate surface contacts said strip member such that said biasing means press said cam holder against said support member thereby releasing pressure applied by said biasing means to force said cam against said support member with said strip member interposed between said can and said support member and enabling said strip member to move.

6. The door check mechanism of claim 1, further comprising movement limiting means arranged in said housing for limiting movement of said locking member said movement limiting means comprising a tab at least partially extending into a recessed surface of said locking member.

7. The door check mechanism of claim 1, further comprising a locking member holder fixedly connected to said locking member, said biasing means comprising an elastic spring operative at one end against said housing and operative at an opposite end against said locking member holder.

8. The door check mechanism of claim 1, further comprising drag exerting means for exerting a drag force onto said strip member to enable said locking member to move without slipping.

9. The door check mechanism of claim 8, further comprising a locking member holder fixedly connected to said locking member, said drag exerting means comprising at least one elastica spring, each mounted at one end to said locking member holder and bearing against said locking member at an opposite end.

10. The door check mechanism of claim 9, wherein said locking member includes at least one recessed arcuate surface, each of said at least one elastica spring bearing against a respective one of said recessed arcuate surfaces.

11. The door check mechanism of claim 1, wherein the door check mechanism is not integrated into a hinge of the door.

12. The door check mechanism of claim 1, wherein said support member comprises an additional movable locking member arranged such that said strip member is interposed between said locking member and said additional locking member.

13. The door check mechanism of claim 12, further comprising drag exerting means for exerting a drag force onto said strip member to enable said locking member and said additional locking member to rotate without slipping, and a locking member holder fixedly connected to said locking member and said additional locking member, said drag exerting means comprising elastica springs, each pivotally mounted at one end to said locking member holder and bearing against said locking member at an opposite end.

14. The door check mechanism of claim 13, wherein said locking member and said additional locking member each include at least one recessed arcuate surface, one of said elastica springs bearing against a respective one of said recessed arcuate surfaces.

15. The door check mechanism of claim 1, further comprising a locking member holder for housing said locking member, said locking member holder including a mounting bracket, and an automatic door closing apparatus for enabling the door to close automatically under its own weight, said automatic door closing apparatus comprising a motor coupled to said housing, and a rod extending into engagement with said support bracket and actuatable by said motor to pull said locking member away from said strip member.

16. The door check mechanism of claim 1, further comprising a locking member holder fixedly connected to said locking member, and drag exerting means for exerting a drag force onto said strip member to enable said locking member to rotate without slipping, said drag exerting means comprising a cantilevered spring mounted at one end to said locking member holder and having its opposite end movable between two projections arranged on said locking member.

17. The door check mechanism of claim 1, wherein said strip member is serrated on a surface engaging said locking member to thereby form alternating teeth and grooves, said locking member having a tip positionable within one of said grooves.

18. The door check mechanism of claim 1, wherein said locking member has a pair of arcuate surfaces adapted to be pressed against said strip member and a pointed tip defined between said arcuate surfaces.

19. The door check mechanism of claim 1, wherein said locking member has a beveled edge, said strip member having a groove for at least partially receiving said beveled edge of said locking member.

20. The door check mechanism of claim 1, wherein said strip member includes means for defining a fixed stop for the door.

21. The door check mechanism of claim 20, wherein said fixed stop defining means comprise projections arranged at a location along a length of said strip member at transverse edges thereat and said locking member having a central shaft, an upper disk, a lower disk and an irregularly shaped section between said upper and lower disks, said projections on said strip member engaging with said upper and lower disks to fix the position of the door.

22. The door check mechanism of claim 1, further comprising dampening means for providing drag on said strip member in order to dampening motion of the door, said dampening means comprising springs mounted onto said housing and brake material mounted on said springs and arranged to be biased by said springs against said strip member.

23. The door check mechanism of claim 1, wherein said locking member comprises a driven member fixedly mounted in said housing, and a movable member interposed between said driven member and said strip member, said movable member being movable along a contoured surface said driven member into different positions to thereby vary the pressure exerted by said biasing means pressing said strip member against said support member.

24. An infinite door check mechanism for enabling a door to be moved from a closed position in a door frame to any one of a plurality of different open positions, comprising a door check housing adapted to be mounted on the door, a support member adapted to be mounted to the frame, said support member including a hinge pin defining a rotational axis about which said support member is rotatable, a hinge member arranged around said hinge pin, a movable locking cam arranged in said housing to engage said hinge member, and biasing means arranged in said housing for selectively pressing said cam against said hinge member to force said cam against said hinge member and thereby retain said hinge member and thus the door in a fixed position and releasing pressure of said cam against said hinge member and thereby enable rotation of said hinge member and thus the door.

25. The door check mechanism of claim 24, further comprising a cam holder fixedly connected to said cam, said biasing means comprising a strip of bent spring material arranged in said housing to exert pressure against said cam holder and thus said cam.

26. The door check mechanism of claim 24, further comprising drag exerting means for exerting a drag force onto said hinge member to enable said cam to rotate without slipping.

27. The door check mechanism of claim 26, further comprising a cam holder fixedly connected to said cam, said drag exerting means comprising at least one elastica spring, each mounted at one end to said cam holder and bearing against said cam at an opposite end.

28. The door check mechanism of claim 27, wherein said cam includes at least one recessed arcuate surface, each of said at least one elastica spring bearing against a respective one of said at least one recessed arcuate surface.

29. An infinite door check mechanism for enabling a door to be moved from a closed position in a door frame to any one of a plurality of different open positions, comprising a door check housing adapted to be mounted on the frame, a support member adapted to be mounted to the door, said support member including a hinge pin defining a rotational axis about which said support member is rotatable, a hinge member arranged around said hinge pin and being adapted to be connected to the door to enable the door to rotate about said axis, a movable locking member arranged in said housing to engage said hinge member, and biasing means arranged in said housing for selectively pressing said locking member against said hinge member to force said locking member against said hinge member and thereby retain said hinge member and thus the door in a fixed position and releasing pressure of said locking member against said hinge member and thereby enable rotation of said hinge member and thus the door.

30. The door check mechanism of claim 29, further comprising a locking member holder fixedly connected to said locking member, said biasing means comprising a strip of bent spring material arranged in said housing to exert pressure against said locking member holder and thus said locking member.

31. The door check mechanism of claim 29, further comprising drag exerting means for exerting a drag force onto said hinge member to enable said locking member to rotate without slipping.

32. The door check mechanism of claim 31, further comprising a locking member holder fixedly connected to said locking member, said drag exerting means comprising at least one elastica spring, each mounted at one end to said locking member holder and bearing against said locking member at an opposite end.

33. The door check mechanism of claim 32, wherein said locking member includes at least one recessed arcuate surface, each of said at least one elastica spring bearing against a respective one of said at least one recessed arcuate surface.

34. An infinite door check mechanism for enabling a door to be moved from a closed position in a door frame to any one of a plurality of different open positions, comprising a door check housing adapted to be mounted on the door, a support member arranged in said housing, an elongate strip member adapted to be mounted to and extend outward from the frame, said strip member extending at least partially through said housing, and a flexible U-shaped element fixedly mounted in said housing and having a section in constant contact with said strip member to urge said strip member against said support member.

35. The door check mechanism of claim 34, wherein said U-shaped element is a spring.

36. The door check mechanism of claim 34, wherein said U-shaped element is a three-bar linkage wherein first and second bars are pivotally mounted at one end to said housing and at an opposite end to a third bar, said third bar being in constant contact with said strip member.

37. A method for making an infinite door check device for holding a door of a particular vehicle model at an arbitrary position between an open position and a closed position, comprising the steps of:

determining the checking torque required to hold the door against the expected forces tending to further open or to close the door;

determining the minimum design coefficient of friction for a door check mechanism including a strip member and a loading member;

selecting materials for the strip member and the loading member of the door check mechanism such that the coefficient of friction between the strip member and the loading member will not be less than the designed minimum coefficient of friction;

selecting a support member design and load to be applied by the loading member to achieve the checking torque; and providing a means for exerting an additional force by the loading member onto the strip member to prevent the loading member from slipping on the strip member when the coefficient of friction is at the minimum value and when the check device is operating to check the motion of the door.

* * * * *